US010792676B2

(12) United States Patent
Morinishi et al.

(10) Patent No.: US 10,792,676 B2
(45) Date of Patent: Oct. 6, 2020

(54) SUCTION DEVICE AND DRIVE DEVICE

(71) Applicants: NAGOYA INSTITUTE OF TECHNOLOGY, Nagoya-shi, Aichi (JP); DENSO CORPORATION, Kariya, Aichi-pref (JP)

(72) Inventors: Yohei Morinishi, Nagoya (JP); Shinji Tamano, Nagoya (JP); Masahiro Hongo, Nagoya (JP)

(73) Assignees: NAGOYA INSTITUTE OF TECHNOLOGY, Nagoya-shi, Aichi-pref. (JP); DENSO CORPORATION, Kariya, Aichi-pref. (JP)

( * ) Notice: Subject to any disclaimer, the term of this patent is extended or adjusted under 35 U.S.C. 154(b) by 0 days.

(21) Appl. No.: 16/226,732

(22) Filed: Dec. 20, 2018

(65) Prior Publication Data

US 2019/0126294 A1 May 2, 2019

Related U.S. Application Data

(63) Continuation of application No. PCT/JP2017/022850, filed on Jun. 21, 2017.

(30) Foreign Application Priority Data

Jun. 22, 2016 (JP) ..... 2016-123282

(51) Int. Cl.
*B04C 3/06* (2006.01)
*F24F 7/007* (2006.01)
(Continued)

(52) U.S. Cl.
CPC ..... *B04C 3/06* (2013.01); *A47L 9/02* (2013.01); *B08B 5/04* (2013.01); *B08B 9/035* (2013.01);
(Continued)

(58) Field of Classification Search
CPC ..... B01D 45/12; B01D 45/14; B01D 59/20; F05B 2260/604; F24F 7/007; F24F 7/06; F24F 9/00; F24F 13/02; F24F 13/26; B08B 5/04; B08B 9/035; B04C 3/00; B04C 3/06; B04C 2003/006; A47L 9/02; A47L 9/16;
(Continued)

(56) References Cited

U.S. PATENT DOCUMENTS 4,692,959 A 9/1987 Monson
5,096,467 A * 3/1992 Matsui ..... B65G 53/24 454/189
(Continued)

FOREIGN PATENT DOCUMENTS

CN 205306904 U 6/2016
JP H05296511 A 11/1993
(Continued)

*Primary Examiner* — Patrick Hamo
*Assistant Examiner* — Chirag Jariwala
(74) *Attorney, Agent, or Firm* — Harness, Dickey & Pierce, P.L.C.

(57) ABSTRACT

The suction device includes a suction port revolving around a revolution axis while sucking a fluid so as to generate an artificial tornado. The suction port revolves around the revolution axis while sucking the fluid, so that it is possible to generate an artificial tornado more stably.

11 Claims, 24 Drawing Sheets

(51) Int. Cl.

| | |
|---|---|
| ***B08B 5/04*** | (2006.01) |
| ***F24F 7/06*** | (2006.01) |
| ***F24F 13/02*** | (2006.01) |
| ***B08B 9/035*** | (2006.01) |
| ***A47L 9/02*** | (2006.01) |
| ***F04D 23/00*** | (2006.01) |
| *B04C 3/00* | (2006.01) |

(52) U.S. Cl.
CPC ..... *F04D 23/001* (2013.01); *F24F 7/007* (2013.01); *F24F 7/06* (2013.01); *F24F 13/02* (2013.01); *B04C 2003/006* (2013.01)

(58) Field of Classification Search
CPC .... F04F 3/00; F04F 99/00; F04D 1/12; F04D 1/04; F04D 1/14; F04D 11/00; F04D 17/06; F04D 17/16; F04D 17/165; F04D 17/18; F04D 23/00; F04D 23/001; F04D 23/003; F04D 23/005
USPC ..... 137/808; 95/34, 35, 269, 270; 55/406, 55/407, 408, 409; 415/88, 89; 417/171
See application file for complete search history.

(56) References Cited

U.S. PATENT DOCUMENTS

| | | | | |
|---|---|---|---|---|
| 6,036,871 | A * | 3/2000 | Eichler | B03B 5/34 210/512.1 |
| 6,643,894 | B1 | 11/2003 | Dell | |
| 2005/0164628 | A1 * | 7/2005 | Lee | F04D 25/166 454/341 |
| 2016/0161133 | A1 | 6/2016 | Oh | |

FOREIGN PATENT DOCUMENTS

| | | | | |
|---|---|---|---|---|
| JP | H-0742996 | A * | 2/1995 | F24F 13/10 |
| JP | H07042996 | A | 2/1995 | |
| JP | H08285340 | A | 11/1996 | |
| JP | 2000234773 | A | 8/2000 | |
| JP | 2008256292 | A | 10/2008 | |
| JP | 2008264682 | A | 11/2008 | |
| JP | 2014181888 | A | 9/2014 | |
| KR | 101193604 | B1 * | 10/2012 | F24F 13/06 |
| WO | WO-2015034273 | A1 | 3/2015 | |

* cited by examiner

FIG. 5

| | R [mm] | N[rpm] | n[rpm] | n/N |
|---|---|---|---|---|
| Case1－1 | 0 | 120 | 0 | 0 |
| Case1－2 | | 150 | | |
| Case1－3 | | 180 | | |
| Case1－4 | 10 | 120 | | |
| Case1－5 | | 150 | | |
| Case1－6 | | 180 | | |
| Case1－7 | 20 | 120 | | |
| Case1－8 | | 150 | | |
| Case1－9 | | 180 | | |
| Case1－10 | 30 | 120 | | |
| Case1－11 | | 150 | | |
| Case1－12 | | 180 | | |

FIG. 16

| | R [mm] | N[rpm] | n[rpm] | n/N |
|---|---|---|---|---|
| Case2－1 | 0 | 120 | 60 | 0.5 |
| Case2－2 | | | 120 | 1 |
| Case2－3 | | | 240 | 2 |
| Case2－4 | | 150 | 75 | 0.5 |
| Case2－5 | | | 150 | 1 |
| Case2－6 | | | 300 | 2 |
| Case2－7 | | 180 | 90 | 0.5 |
| Case2－8 | | | 180 | 1 |
| Case2－9 | | | 360 | 2 |
| Case2－10 | 10 | 120 | 60 | 0.5 |
| Case2－11 | | | 120 | 1 |
| Case2－12 | | | 240 | 2 |
| Case2－13 | | 150 | 75 | 0.5 |
| Case2－14 | | | 150 | 1 |
| Case2－15 | | | 300 | 2 |
| Case2－16 | | 180 | 90 | 0.5 |
| Case2－17 | | | 180 | 1 |
| Case2－18 | | | 360 | 2 |
| Case2－19 | 20 | 120 | 60 | 0.5 |
| Case2－20 | | | 120 | 1 |
| Case2－21 | | | 240 | 2 |
| Case2－22 | | 150 | 75 | 0.5 |
| Case2－23 | | | 150 | 1 |
| Case2－24 | | | 300 | 2 |
| Case2－25 | | 180 | 90 | 0.5 |
| Case2－26 | | | 180 | 1 |
| Case2－27 | | | 360 | 2 |
| Case2－28 | 30 | 120 | 60 | 0.5 |
| Case2－29 | | | 120 | 1 |
| Case2－30 | | | 240 | 2 |
| Case2－31 | | 150 | 75 | 0.5 |
| Case2－32 | | | 150 | 1 |
| Case2－33 | | | 300 | 2 |
| Case2－34 | | 180 | 90 | 0.5 |
| Case2－35 | | | 180 | 1 |
| Case2－36 | | | 360 | 2 |

SUCTION DEVICE AND DRIVE DEVICE

CROSS REFERENCE TO RELATED APPLICATION

The present application is a continuation application of International Patent Application No. PCT/JP2017/022850 filed on Jun. 21, 2017, which designated the United States and claims the benefit of priority from Japanese Patent Application No. 2016-123282 filed on Jun. 22, 2016. The entire disclosures of all of the above applications are incorporated herein by reference.

TECHNICAL FIELD

The present invention relates to a suction device having a suction port for sucking a fluid, and a driving device.

BACKGROUND

Conventionally, a suction device has a suction port for sucking a fluid. The suction device generates and sucks an artificial tornado.

SUMMARY

A suction device includes a suction port revolving around a revolution axis while sucking a fluid so as to generate an artificial tornado. The suction port revolves around the revolution axis while sucking the fluid, so that it is possible to generate an artificial tornado more stably.

BRIEF DESCRIPTION OF THE DRAWINGS

The above and other objects, features and advantages of the present disclosure will become more apparent from the following detailed description made with reference to the accompanying drawings. In the drawings:

FIG. 5 is a diagram showing experimental conditions of Example 1 and Example 2;

FIG. 16 is a diagram showing experimental conditions of Example 3;

DETAILED DESCRIPTION

Figure 20:
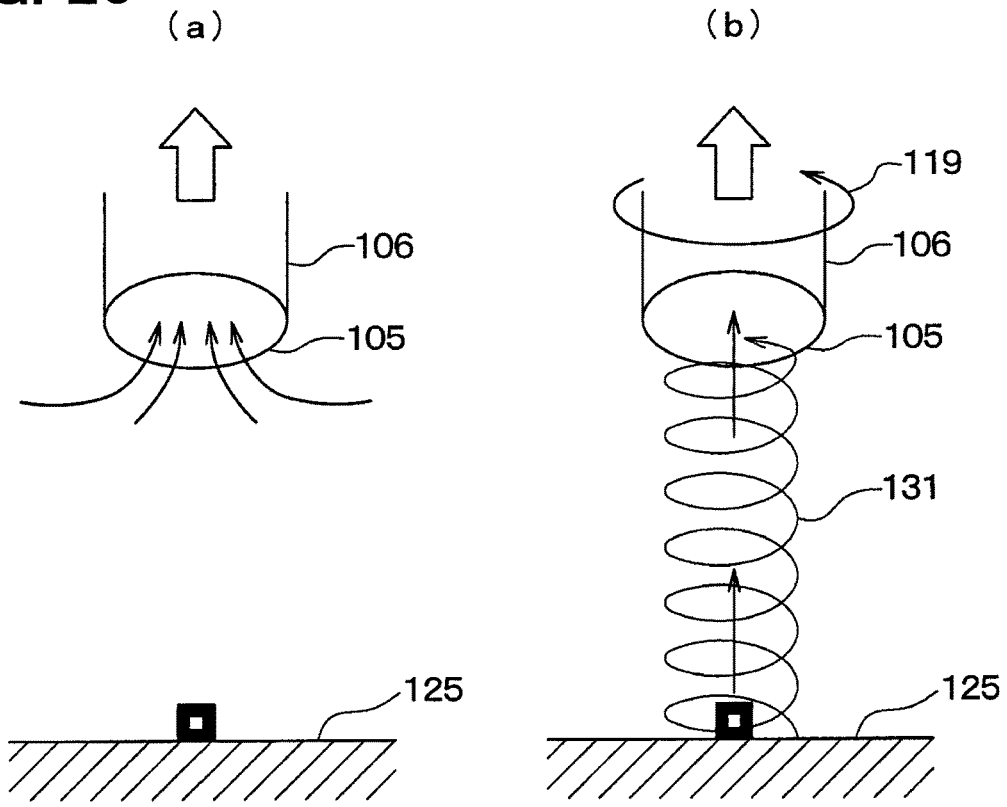
FIG. 20 is a diagram showing a flow of a related suction port.

FIG. 20 shows a flow by a related suction port. In the example shown in FIG. 20 (*a*), the potential flow generated by the usual stationary suction port 105 is generated as shown by the arrow. In the example of (a), air as a fluid forms a potential flow and is uniformly sucked into the suction port 105 at a speed inversely proportional to the distance from the suction port 105. Therefore, the suction flow is dispersed without directivity, and the suction airflow does not reach the floor surface 125.

In the related technique shown in FIG. 20 (*b*), air is sucked into the suction port 105 while forming the artificial tornado 131. In this example, the suction port 105 and the suction port duct 106 rotate in the rotation direction 119. Then, due to frictional resistance between the inner wall of the suction port duct 106 and the air, a vortex of air indicated by an arrow, that is, an artificial tornado 131 is generated. Since the dispersion of the suction flow is reduced by the artificial tornado 131 and the directivity of the suction flow is generated, the suction airflow reaches the floor surface 125.

Figure 21:
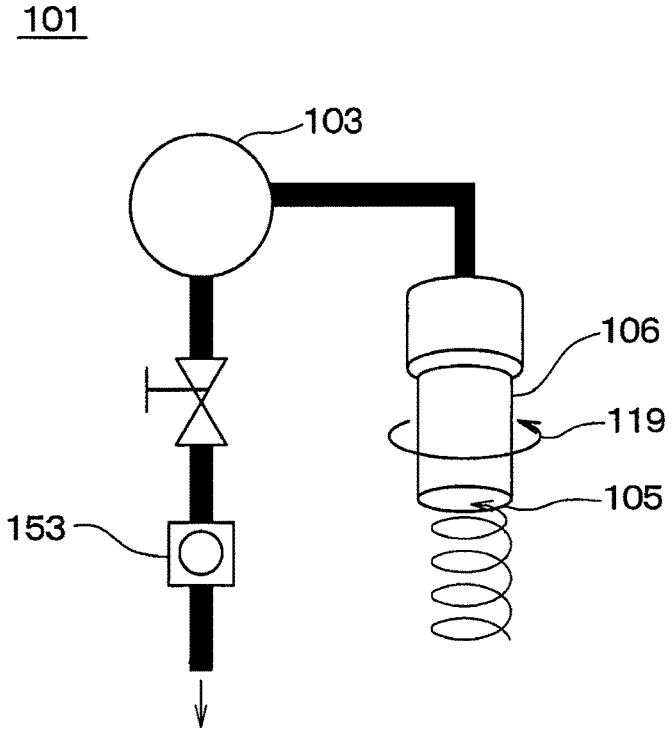
FIG. 21 is a diagram showing an example of a suction device for generating a related artificial tornado.

FIG. 21 shows an example of the suction device 101 for generating the artificial tornado 131 as shown in FIG. 20 (*b*). The suction device 101 generates an artificial tornado 131 by rotating a cylindrical suction port duct 106 having a suction port 105. The sucked air is exhausted to the outside of the suction device 101 via the suction pump 103 and the flow meter 153.

The artificial tornado 131 is generated by the rotation of the suction port duct 106 having the cylindrical shape. However, since the force of rotating the air by the inner wall of the suction port duct 106 is weak, the rotational force of the artificial tornado 131 is weak and unstable. Therefore, it is difficult to continuously generate the artificial tornado 131.

Based on the above examples, apparatus generates and sucks an artificial tornado 131. A ventilator may generate an artificial tornado 131 by rotating a fan having a diameter larger than the suction port together with a cylindrical duct fan having the same diameter as the fan at the suction port. In this ventilator, since the entire length of the cylindrical duct is required to be twice or more greater than the thickness of the fan, the size of the ventilator becomes large. Also, it is necessary to provide a guide vane or the like inside the cylindrical duct and to install the guide vane integrally with the fan.

Alternatively, an air intake nozzle may provide an air intake port together with a conical duct attached to a suction port so as to generate a swirling flow around the large diameter side of the duct. This intake nozzle becomes large, and a blower that supplies a jet flow to the air intake port is necessary.

Although the above apparatuses generate an artificial tornado with only a structure for suctioning, a rotating cylindrical duct having the large diameter or a conical duct and a blower supplying a jet are required.

Alternatively, an air exhaust device may generate an artificial tornado 131 and suck the air into a suction port by discharging the air so as to provide the swirling flow from an air discharge port of four pipes forming the air curtain inside a zone, which is formed by the air curtain on a downstream side of a large hood that collects a suction flow around a suction port. This exhaust device requires a large-sized hood, a pipe for an air curtain, and a blower for generating a dedicated jet flow for the air curtain.

Alternatively, a ventilation device may have a large hood attached around a suction port, discharge a jet stream of outside air to the inside of the hood in the circumferential direction so as to generate a swirling flow, discharge the swirling flow as a primary tornado to the floor surface on the upstream side, and generate a secondary tornado as a reflected stream of the floor surface so as to suck the air into the suction port. This ventilation device requires a large hood, a blower dedicated to the jet flow for generating the primary tornado, and a floor surface for generating the secondary tornado (i.e., the artificial tornado 131).

Alternatively, a firing cooking device with a ventilation device may have a suction port disposed on one side and a discharge port disposed on the other side, have a cylindrical duct provided on an upstream side of the discharge port, generate a jet flow as a discharging and swirling flow along the circumference so as to generate an artificial tornado from the discharge port, and sucks the air into a suction port. This firing cooking device requires a discharge device on the other side of the suction port.

In the above devices, a floor surface and a device for blowing the jet flow are necessary not only on the suction side, but also on the other side, and therefore, it is necessary to equip a large-size equipment.

Therefore, in the related devices using the artificial tornado, there is a difficulty that a large duct and a large hood for generating an artificial tornado, and a blower for the jet flow generating the swirling flow are required.

An example object of the present disclosure is to provide a suction device for stably generating an artificial tornado on a suction side.

According to one example of the present disclosure, the suction device includes a suction port that revolves around a revolution axis while sucking a fluid. As described above, the suction port revolves around the revolution axis while sucking the fluid, so that it is possible to generate an artificial tornado more stably than before.

According to another example, when the suction port revolves around the revolution axis, a revolution zone is formed in a region inside the shape drawn by the outermost peripheral portion of the suction port.

By revolving the suction port and forming the revolution zone, air is drawn into the suction port in the circumferential direction, and thereby generating the circumferential velocity vector $V\theta$ in the revolution zone. The circumferential velocity vector $V\theta$ provides a suction system that generates a strong and stable artificial tornado. Thus, it is possible to generate an artificial tornado even with only a mechanism for revolving the suction port of the suction device.

According to another example, a negative pressure region is generated inside the revolution zone when the suction port revolves around the revolution axis.

In this way, by arranging the negative pressure region inside the revolution zone, it is possible to further strengthen the radial velocity vector Vr. Therefore, a powerful and stable artificial tornado can be generated by the synthetic velocity vector Vt between the circumferential velocity vector $V\theta$ and the radial velocity vector Vr.

According to another example, the suction speed of the revolution zone has a velocity gradient that decreases from the inside to the outer circumference of the revolution axis. In this way, a radial velocity vector Vr affecting in the radial direction of the circle around a center as the revolution center 10 is generated.

According to another example, the suction device includes a driving device that controls the suction port to revolve around the revolution axis when the suction port sucks the fluid. With such a driving device, it is possible to generate an artificial tornado more stably than before.

According to another example, the suction device includes a suction port duct having the suction port, a connection duct connected to the suction port duct, and a suction duct connected to the connection duct. Further, the suction duct extends and surrounds the revolution axis so that the revolution axis is located inside. Further, the connection duct extends away from the revolution axis from the opening on the suction duct side to the opening on the suction port duct side. In addition, the suction port duct is located away from the revolution axis. Further, when the suction duct rotates around the revolution axis, the connection duct and the suction port duct revolve around the revolution axis, and as a result, the suction port revolves around the revolution axis. With such a simple configuration, it is possible to generate an artificial tornado stably more than before.

Further, according to another example, the suction device includes a rotation plate having the suction port opening, a suction port duct connected to the rotation plate, and a suction duct connected to the suction port duct. In addition, the suction port in the rotation plate is opened at a position distant from the revolution axis. Also, when the rotation plate rotates about the revolution axis, the suction port revolves around the revolution axis. With such a simple configuration, it is possible to generate an artificial tornado stably more than before.

According to another example, the suction port rotates. By rotating the suction port, the artificial tornado can be further strengthened and stabilized. This is because the frictional force generated on the inner wall of the suction port duct is utilized.

According to another example, the driving device controls the suction port to revolve around the revolution axis when the suction port is sucking the fluid. In this way, by operating the driving device so that the suction port revolves around the revolution axis while sucking the fluid, it is possible to generate an artificial tornado more stably than before.

Hereinafter, embodiments of the present invention will be described with reference to the drawings. The present invention is not limited to the following embodiments, but can be changed, modified, and improved without departing from the scope of the invention.

First Embodiment

Figure 1:
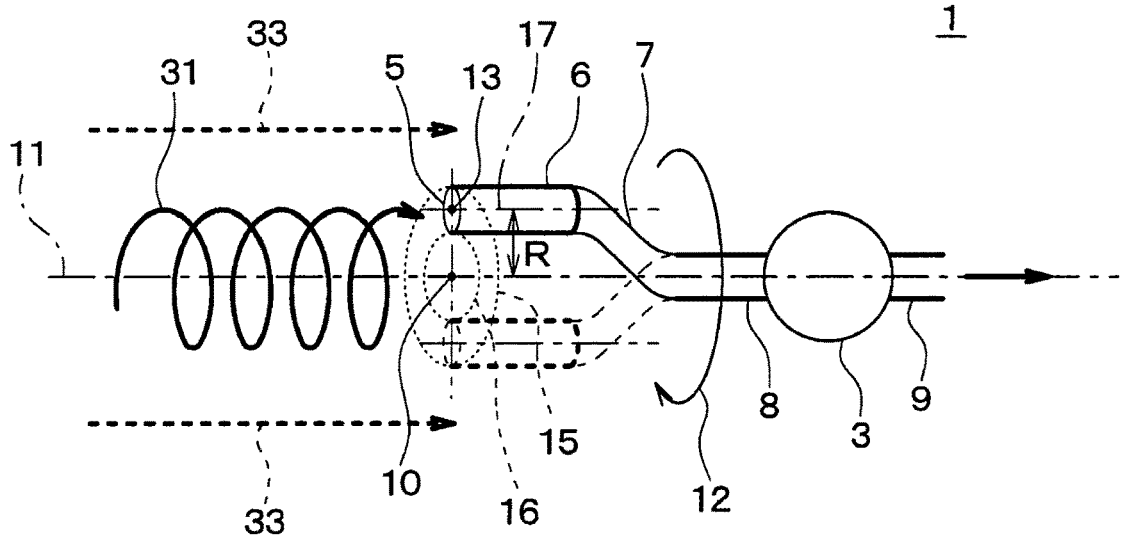
FIG. 1 is a diagram showing a suction device according to a first embodiment.

FIG. 1 shows a first embodiment of the present invention. In the first embodiment, the revolution of the suction port 5 is realized by the rotation of the suction duct 8 around the revolution axis 11.

The suction device 1 of the present embodiment has a suction port duct 6, a connection duct 7, a suction duct 8, a suction pump 3, a discharge duct 9, and a driving device (not shown). The suction port duct 6 has a suction port 5 at the side thereof farther from the connection duct 7. The suction port duct 6, the connection duct 7, and the suction duct 8 rotate integrally.

When the suction port duct 6, the connection duct 7, and the suction duct 8 rotate integrally, the suction port 5 revolves around the revolution center 10. The revolution center 10 is disposed on the revolution axis 11. The suction port 5 has a circular shape, and the center point of the circle is defined as the revolution point 13. The distance between the revolution point 13 and the revolution center 10 is defined as the revolution radius R. The revolution zone 15 is a region inside the shape (that is, an arc) drawn by the outermost peripheral portion of the suction port 5 when the suction port 5 revolves around the revolution center 10. In addition, the outermost peripheral portion indicates the outermost circumference in the radial direction around the revolution axis 11. When the suction port 5 revolves around the revolution center 10, the inside of the suction port inner trajectory 16 drawn by the innermost portion of the suction port 5 is also included in the revolution zone 15. The term "innermost" refers to the radially innermost portion centered on the revolution shaft 11.

When the suction pump 3 operates while the suction port 5 revolves, air flows into the suction port duct 6 from the suction port 5, and then the air passes through the connection duct 7, the suction duct 8, the suction pump 3, and the discharge duct 9 in this order, and after that, the air flows out from the discharge duct 9.

That is, an opening of the suction port duct 6 having the suction port 5 on the side close to the connection duct 7 is connected to one opening of the connection duct 7. The other opening of the connection duct 7 is connected to one opening of the suction duct 8. The other opening of the suction duct 8 is connected to the suction port of the suction pump 3. One opening of the discharge duct 9 is connected to the discharge port of the suction pump 3. The other opening of the discharge duct 9 is open.

The suction duct 8 surrounds the revolution axis 11 and extends along the revolution axis 11 so that the revolution axis 11 is positioned inside the suction duct 8. The connection duct 7 extends away from the revolution axis 11 from the opening of the connection duct 7 on the suction duct 8 side to the opening of the duct 7 on the suction port duct 6 side. The suction port duct 6 extends in parallel to the revolution axis 11 at a position distant from the revolution axis 11.

When the suction duct 8 is driven by a driving device (for example, an electric motor) not shown and rotates about the revolution axis 11 as a center in the direction 12, the connection duct 7 and the suction port duct 6 revolve around the revolution axis 11. As a result, as described above, the suction port 5 revolves around the revolution center 10. The revolution orbit of the revolution point 13 is a circle centered on the revolution center 10.

The revolution axis 11 coincides with the center line of the suction duct 8 in the suction device 1. Therefore, when the driving device not shown controls the suction duct 8 to rotate around the center line of the suction duct 8, the suction port 5 revolves around the revolution axis 11 with the revolution radius R.

When the suction port 5 sucks air while revolving, the air forms an artificial tornado 31 and is sucked into the suction port 5. Since the air is a continuous fluid, the revolution speed N of the suction port 5 is substantially equal to the revolution number of the vortex of the artificial tornado 31. The artificial tornado 31 is formed in the direction of the revolution axis 11 on the upstream side of the suction port 5. Therefore, a suction flow having a directivity in the direction of the revolution axis 11 caused by the artificial tornado 31 is formed.

Air around the artificial tornado 31 is hardly sucked by the artificial tornado 31 and flows toward the suction device 1 side as an accompanying flow 33 with a low speed.

Second Embodiment

Figure 2A:
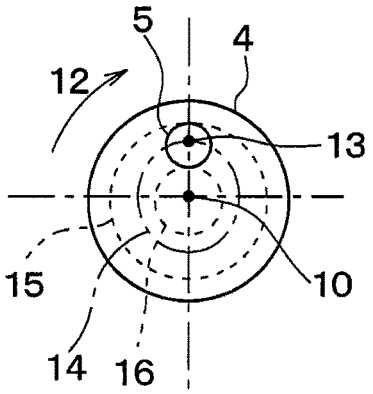
FIG. 2A is a diagram showing a front view of a suction device according to a second embodiment.
Figure 2B:
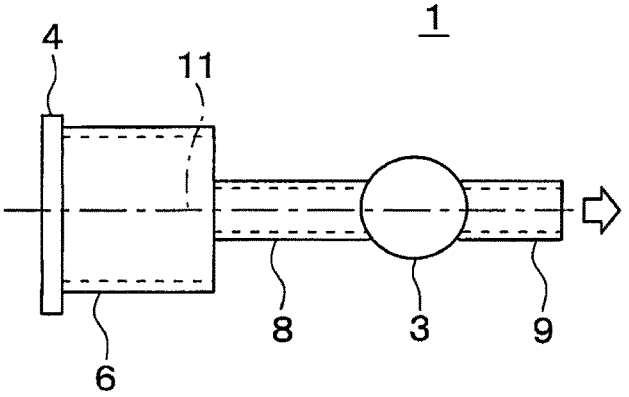
FIG. 2B is a diagram showing a side view of the suction device according to the second embodiment.

FIG. 2A and FIG. 2B show a second embodiment of the present invention. FIG. 2A is a front view of the suction device 1 in this embodiment, and FIG. 2B shows a side view of the suction device 1 in this embodiment. In the second embodiment, revolution of the suction port 5 is realized by rotation of the rotation plate 4 about the revolution center 10. The revolution center 10 is disposed on the revolution axis 11 as in the first embodiment. Although the rotation plate 4 has a disk shape, the plate may have another shape.

In FIG. 2B, the rotation plate 4 rotates around the revolution axis 11 by a driving device (not shown) such as a motor. The suction port duct 6 and the suction duct 8 may or may not rotate integrally with the rotation plate 4.

The hole drilled in the rotation plate 4 is the suction port 5. The rotation plate 4 is connected to one opening of the suction port duct 6. The other opening of the suction port duct 6 is connected to one end of the suction duct 8. The center lines of the suction port duct 6 and the suction duct 8 are the same and are the revolution axis 11, and the center of the rotation plate 4 is disposed on the revolution axis 11 and provides the revolution center 10.

The other opening of the suction duct 8 is connected to the suction port 5 of the suction pump 3. One opening of the discharge duct 9 is connected to the discharge port of the suction pump 3. The other opening of the discharge duct 9 is open.

The diameter of the suction port duct 6 is larger than the diameter of the suction duct 8. Alternatively, the diameter of the suction port duct 6 may be tapered from the one opening on the rotary plate 4 side to the other opening on the suction duct 8 side, so as to reduce air resistance inside the suction port duct 6.

When the suction pump 3 of the suction device 1 is driven while the rotation plate 4 is rotating, the air is sucked from the suction port 5, flows into the suction port duct 6 from the suction port 5, and then flows through the suction duct 8, the suction pump 3, and the discharge duct 9 in this order, and discharges from the other opening of the discharge duct.

In FIG. 2A, the suction port 5 arranged in the rotation plate 4 is opened at a position away from the revolution axis 11 in the rotary plate 4. Therefore, when the rotation plate 4 rotates, it revolves in the revolution direction 12 around the revolution center 10.

Since the air is a continuous fluid, the revolution speed N of the suction port 5 is substantially equal to the revolution number of the vortex of the artificial tornado 31. The suction port 5 has a circular shape, and the center point of the circle is the revolution point 13. The distance between the revolution point 13 and the revolution axis 11 is defined as the revolution radius R. Due to the rotation of the rotation plate 4, the revolution point 13 draws a circular revolution trajectory 14 with a revolution radius R.

The revolution zone 15 is a circular arc region that is drawn by the outermost peripheral portion of the suction port 5 when the suction port 5 revolves around the revolution center 10. When the suction port 5 revolves around the revolution center 10, the inside of the suction port inner trajectory 16 drawn by the innermost portion of the suction port 5 is also disposed in the revolution zone 15.

As described above, in the present embodiment, the suction port duct 6 and the suction duct 8 surround the revolution axis 11 and extend along the axis 11 so as to arrange the revolution axis 11 inside the ducts 6 and 8. Further, the suction port 5 is opened at a position in the rotation plate 4 away from the revolution axis 11. Further, when the rotation plate 4 rotates about the revolution axis 11, the suction port 5 revolves around the revolution axis 11.

In the first embodiment and the second embodiment, the following features are commonly owned. The suction port inner trajectory 16 is provided when the revolution radius R is larger than the suction port radius, and is not provided when the revolution radius R is smaller than the suction port radius.

The revolution point 13 of the suction port 5 revolves around the revolution axis 11 with the revolution radius R. The shape of the suction port 5 may be not only a circular shape but also an elliptical shape, a square shape or the like. The revolution point 13 may not be the center of the suction port 5 as long as the point 13 can regulate the revolution of the suction port 5. The revolution trajectory of the revolution point 13 is indicated by a revolution locus 14. The revolution direction 12 may be opposite to the direction shown in FIGS. 1 and 2A. In this case, the flow of the vortex of the artificial tornado 31 also directs to the opposite direction.

Experimental Result

Figure 3:
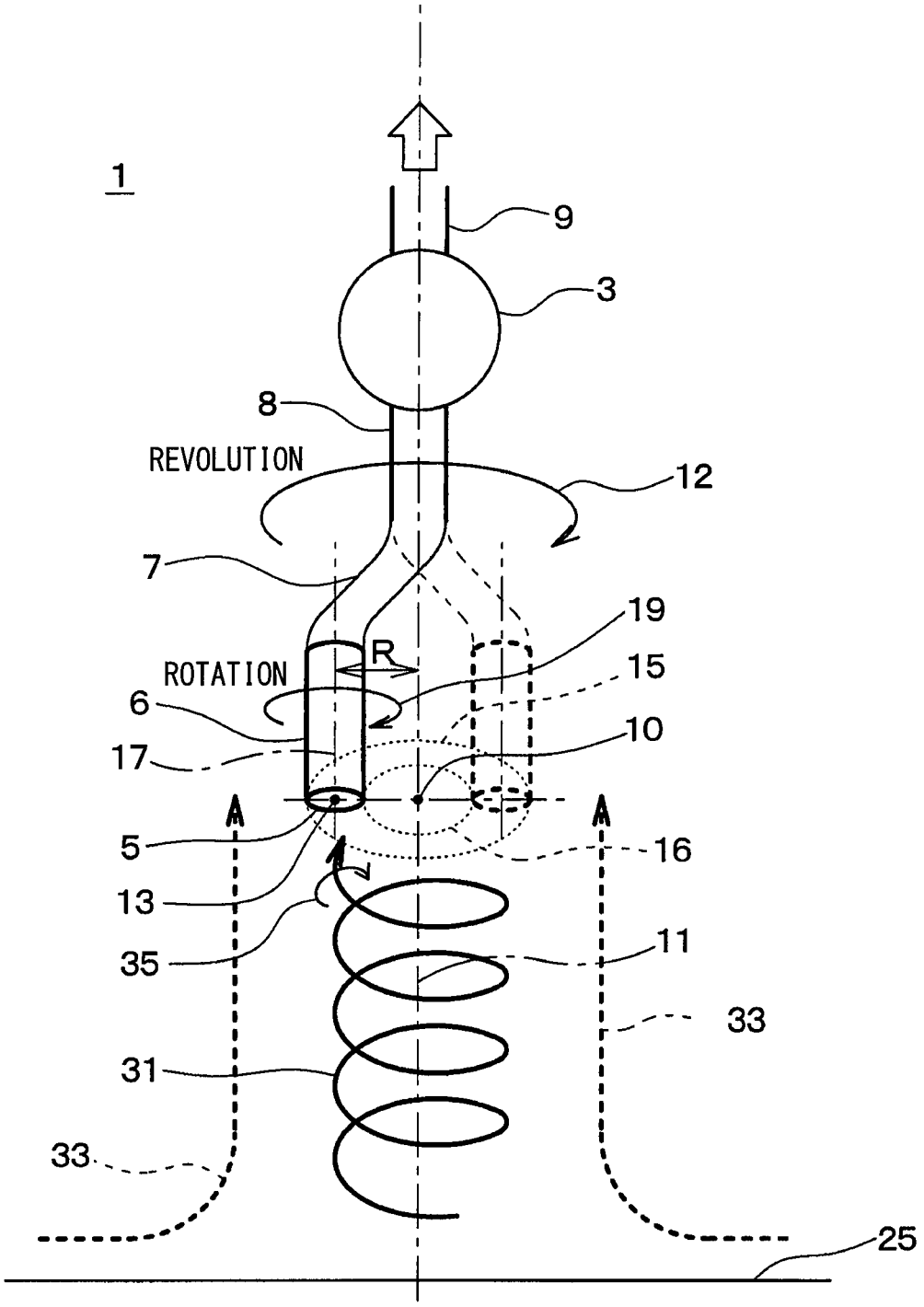
FIG. 3 is a diagram showing a schematic view of the experimental state.

FIG. 3 shows a schematic view of an experimental environment in which the suction device 1 of the first embodiment shown in FIG. 1 is installed vertically on a floor surface 25. The revolution direction 12 of the suction port 5 and the rotation direction 19 of the suction port duct 6 are the same rotation direction. When the suction port duct 6 rotates in the rotation direction 19, the rotation of the autorotation in the rotation direction 35 is applied to the artificial tornado 31. The rotation of the suction port duct 6 indicates the rotation of the suction port duct 6 with respect to the coordinate system rotating around the revolution axis 11 together with the suction port 5.

When the suction port 5 revolves, the accompanying flow 33 flows on the floor surface 25 horizontally so as to be drawn toward the artificial tornado 31, and flows to the vertically upside toward the suction device 1 at the vicinity of the artificial tornado 31.

Figure 4:
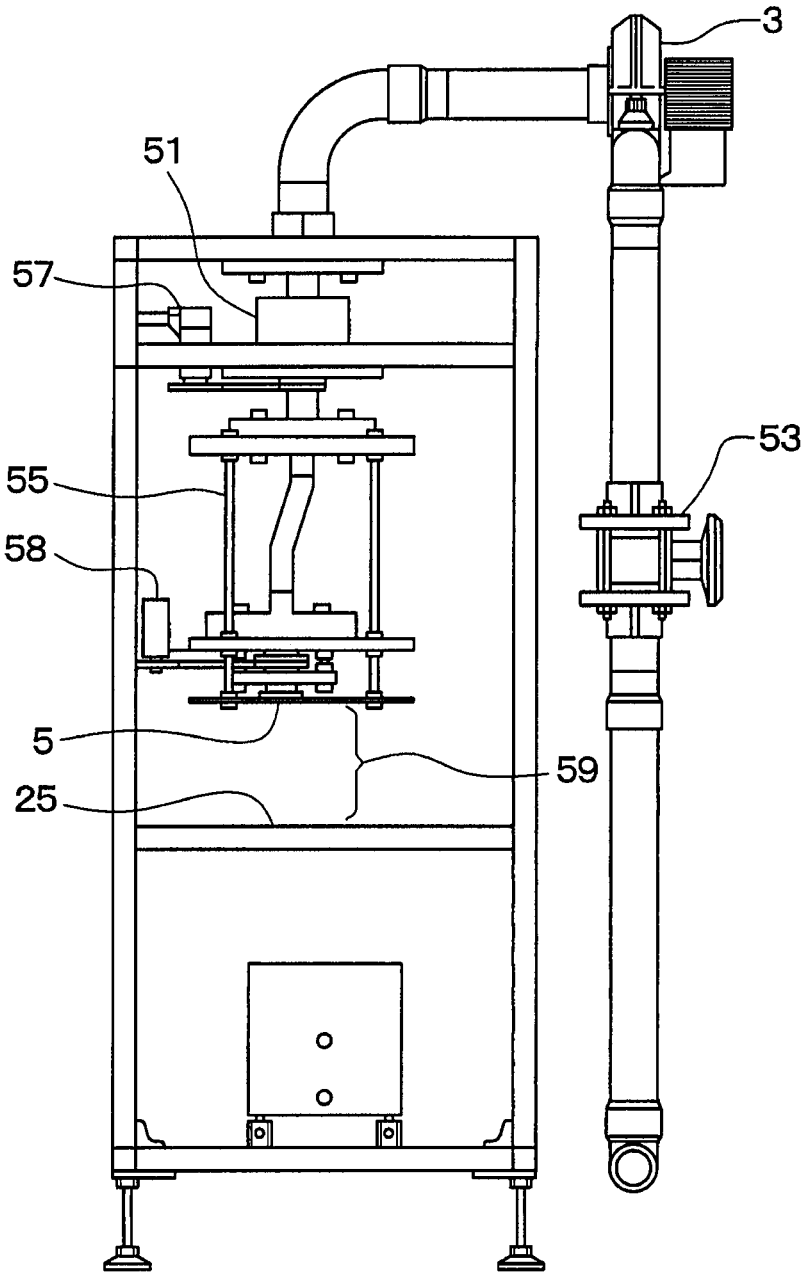
FIG. 4 is a diagram showing an experimental device.

FIG. 4 shows an experimental device embodying the schematic diagram of the experimental state shown in FIG. 3. A flow meter 53 for measuring the air flow rate is arranged on the discharge side of the suction pump 3.

The area between the suction port 5 and the floor surface 25 is the observation region 59. The height of the observation region 59 is 200 mm. The driven unit 55 corresponds to the suction port duct 6, the connection duct 7, and the suction duct 8 shown in FIG. 3. The first motor 57 is a driving device that revolves the suction port 5 by rotating the driven unit 55.

A second motor 58 for rotating the suction port 5 is mounted on the lower portion of the driven unit 55. The second motor 58 moves together with the driven unit 55. In order to supply power to the second motor 58, a slip ring 51 having a brush function is mounted on the upper portion of the driven unit 55. The visualization observation of the artificial tornado 31 in the observation region 59 is carried out using dry ice mist and tuft.

Example 1

In Example 1, it is confirmed that the artificial tornado 31 is generated only by revolution of the suction port 5 and only by rotation of the suction port 5. FIG. 5 shows experimental conditions of Example 1 and Example 2. Air volume Q is 60 $m^3/h$. The inner diameter of the suction port 5 is 32 mm. These features are also applies to Example 3.

Cases 1-1, 1-2, and 1-3 show experimental conditions of an example in which the suction port 5 only rotates. This is a condition of the example of only the rotation of the related suction port 105 and the related suction port duct 106 shown in the example (b) of FIG. 20.

Under this experimental condition, the second motor 58 turns off, and the revolution radius R is set to be 0 mm, and the first motor 57 turns on. Therefore, the revolution speed N in FIG. 5 actually corresponds to the rotation speed n of the suction port 5, not the revolution speed of the suction port 5. Therefore, the rotation speed n is set to be 120 rpm, 150 rpm, and 180 rpm, respectively.

Experimental conditions with only revolution are shown in Cases 1-4 to 1-12. In Cases 1-4, 1-5, and 1-6, the revolution radius R is 10 mm. For Case 1-7, 1-8, 1-9, the revolution radius R is 20 mm. For Case 1-10, 1-11, 1-12, the revolution radius R is 30 mm.

The revolution speed N is 120 rpm, 150 rpm, and 180 rpm, respectively. Observation of the occurrence situation of the artificial tornado 31 is performed for 3 minutes each.

Figure 6A:
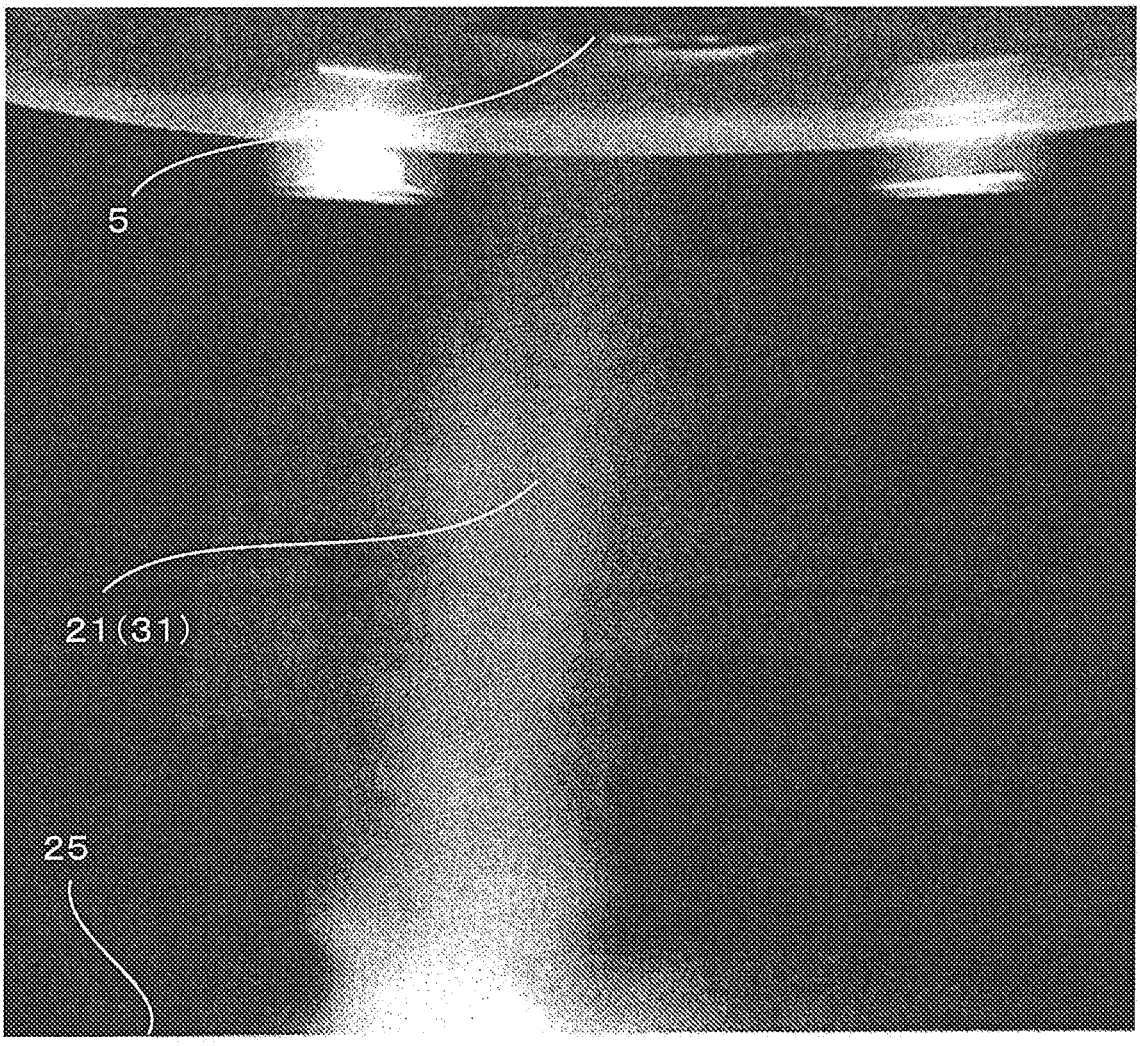
FIG. 6A is a diagram showing the results of Example 1 (i.e., dry ice mist)
Figure 6B:
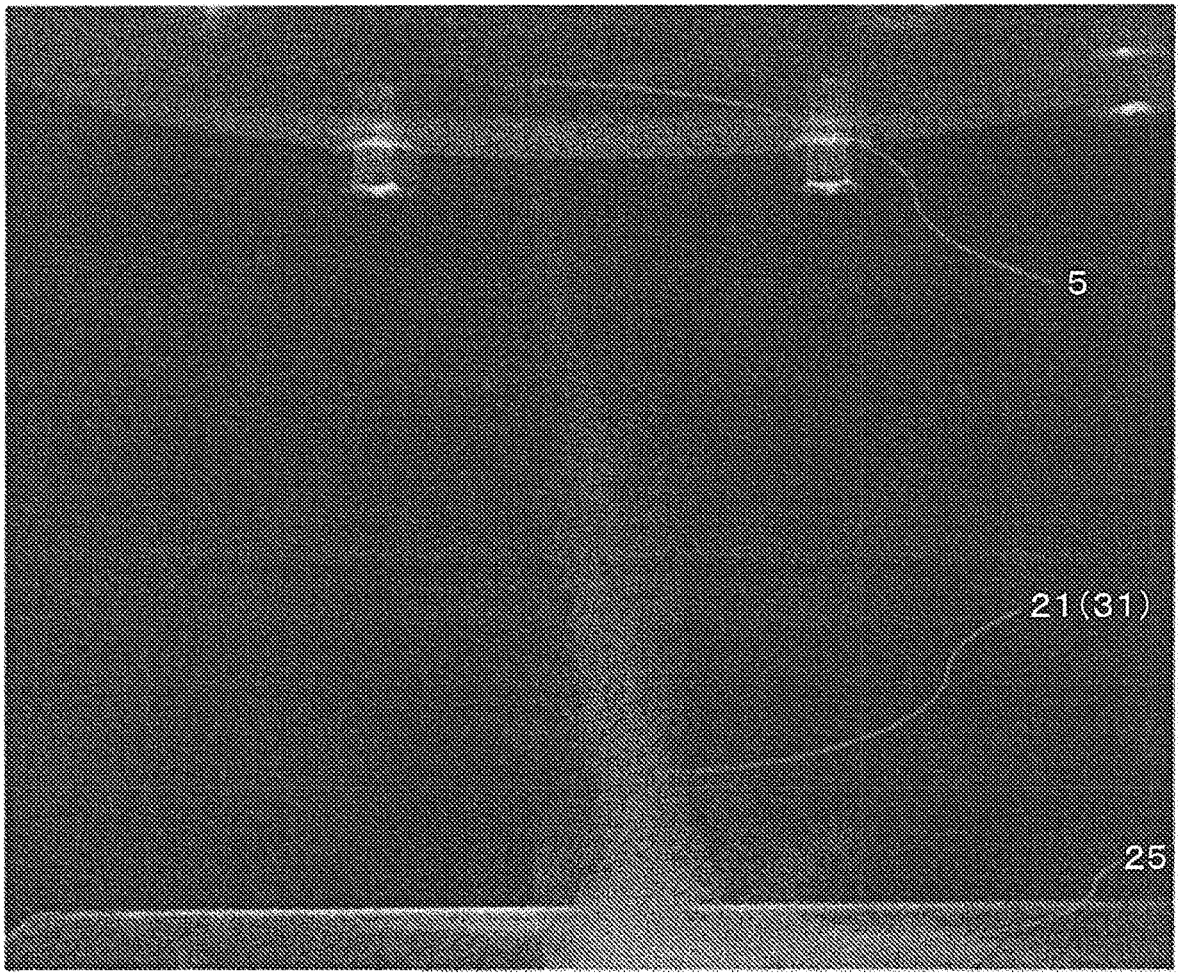
FIG. 6B is a diagram showing the results of Example 1 (i.e., dry ice mist)

FIG. 6A and FIG. 6B show the results of Example 1. In this experimental result, dry ice mist is used for visualization of air flow. FIG. 6A corresponds to Case 1-12, with revolution radius R=30 mm, revolution speed N=180 rpm, rotation speed n=0 rpm, and revolution only.

FIG. 6B corresponds to Case 1-3, with revolution radius R=0 mm, revolution speed N=0 rpm, rotation speed n=1800 rpm, and rotation only.

In the example of revolution only in FIG. 6A, the artificial tornado 31 continues for 3 minutes without interruption during the observation, and the thickness of the vortex tube is almost constant. On the other hand, in the case of the rotation only in FIG. 6B, the artificial tornado 31 does not continue for 3 minutes but continues about 120 seconds at the longest. In addition, the thickness of the vortex tube became thinner as it approaches the suction port 5. As described above, the artificial tornado 31 is observed strongly and fairly stably in the case of only revolution as compared with the case of only rotation.

Figure 7A:
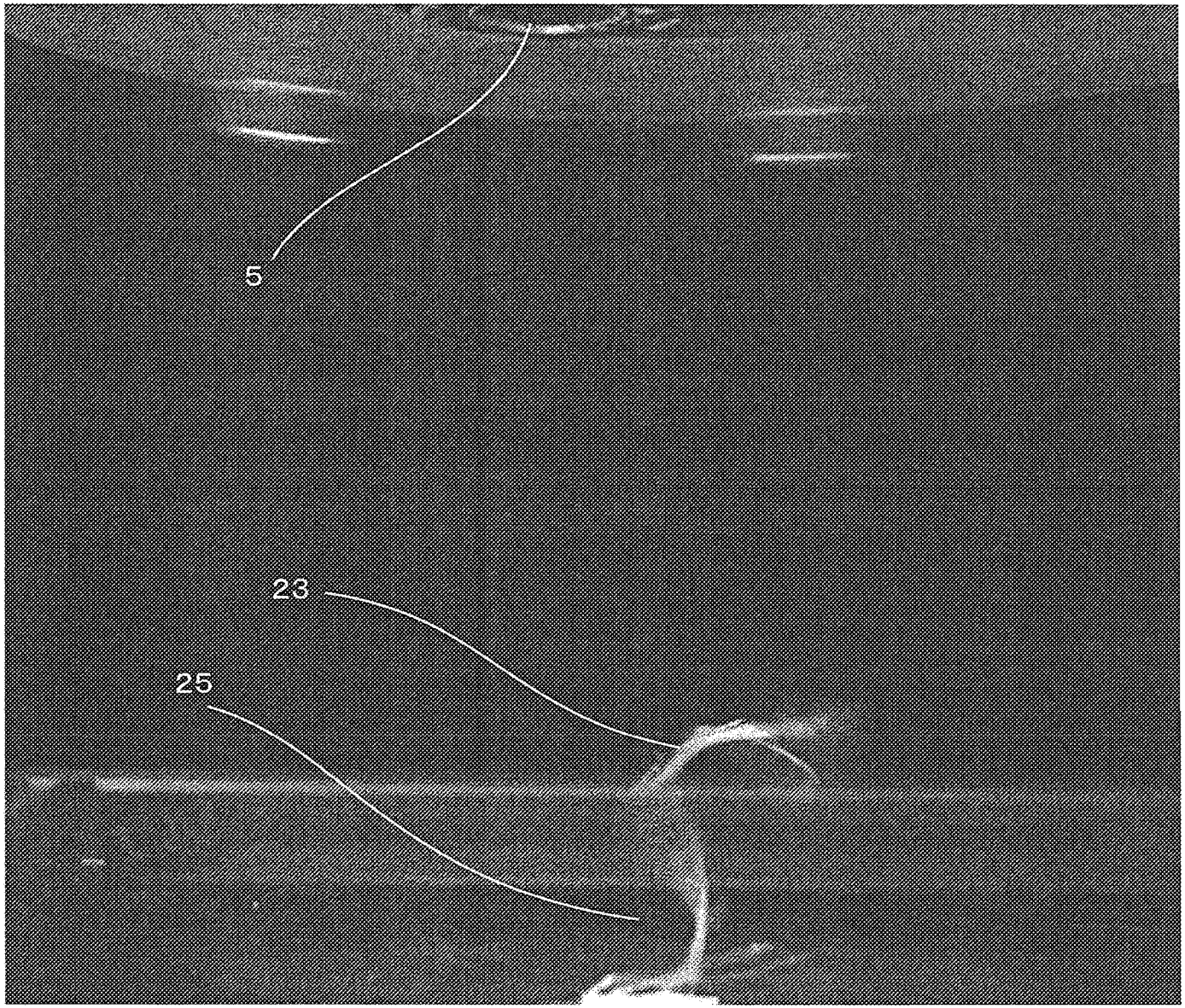
FIG. 7A is a diagram showing the results of Example 1 (i.e., tuft)
Figure 7B:
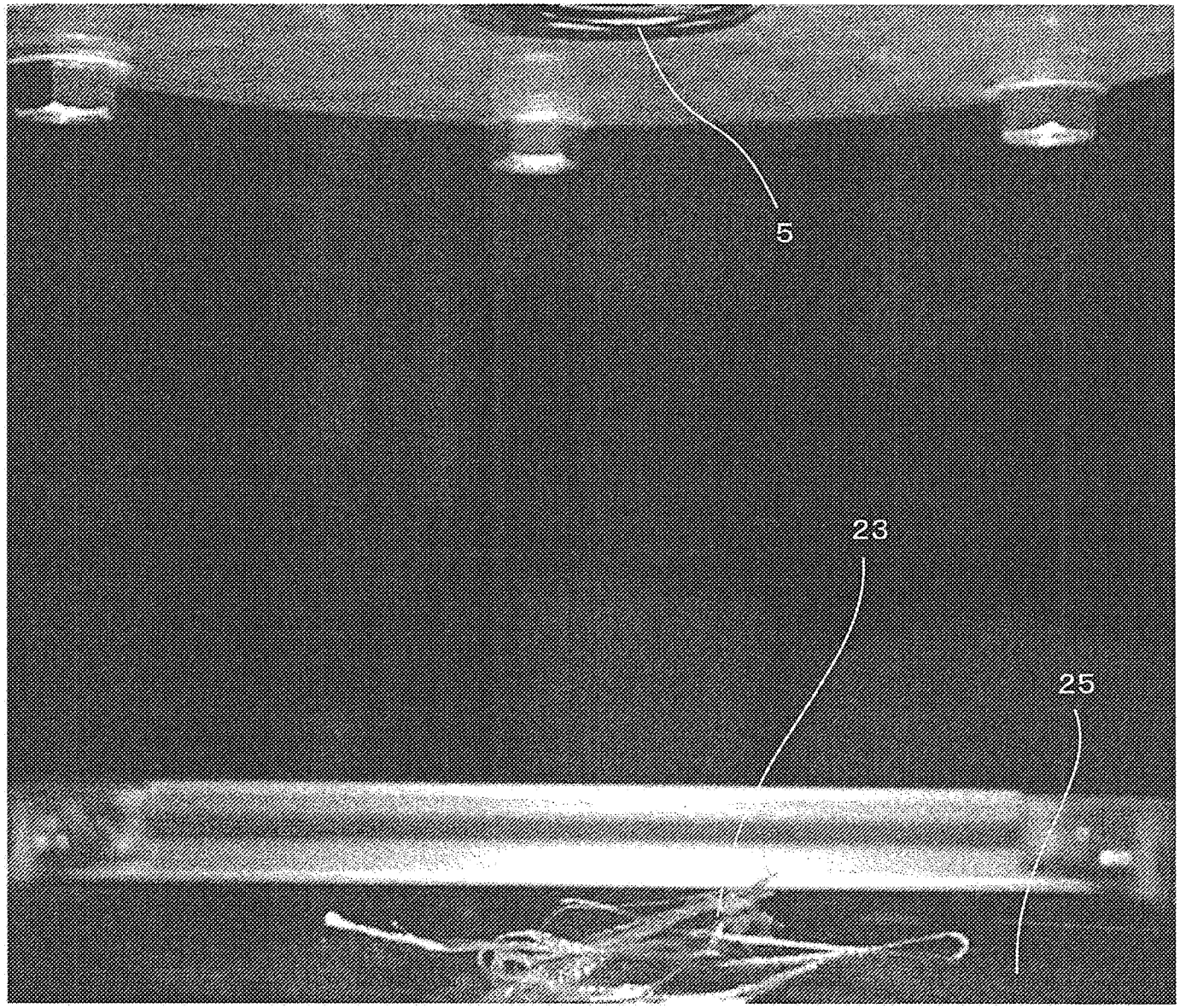
FIG. 7B is a diagram showing the results of Example 1 (i.e., tuft)

FIG. 7A and FIG. 7B show the results of Example 1. In this experimental result, tuft is used for visualization of air flow. Other conditions are the same in FIGS. 7A and 6A, and the same in FIGS. 7B and 6B.

A tuft 23 is attached to the vicinity of the intersection with the revolution axis 11 on the floor surface 25, and the suction force of the artificial tornado 31 on the floor surface 25 is observed. In the example of revolution only in FIG. 7A, it is confirmed that the artificial tornado 31 continues without interruption and the tuft 23 is lifted vertically for 3 minutes during observation. Therefore, it is confirmed that remote suction is possible. On the other hand, with the rotation only in FIG. 7B, the artificial tornado 31 is observed such that the tuft 23 cannot be lifted in the vertical direction. Therefore, it is confirmed that remote suction is difficult.

Figure 8:
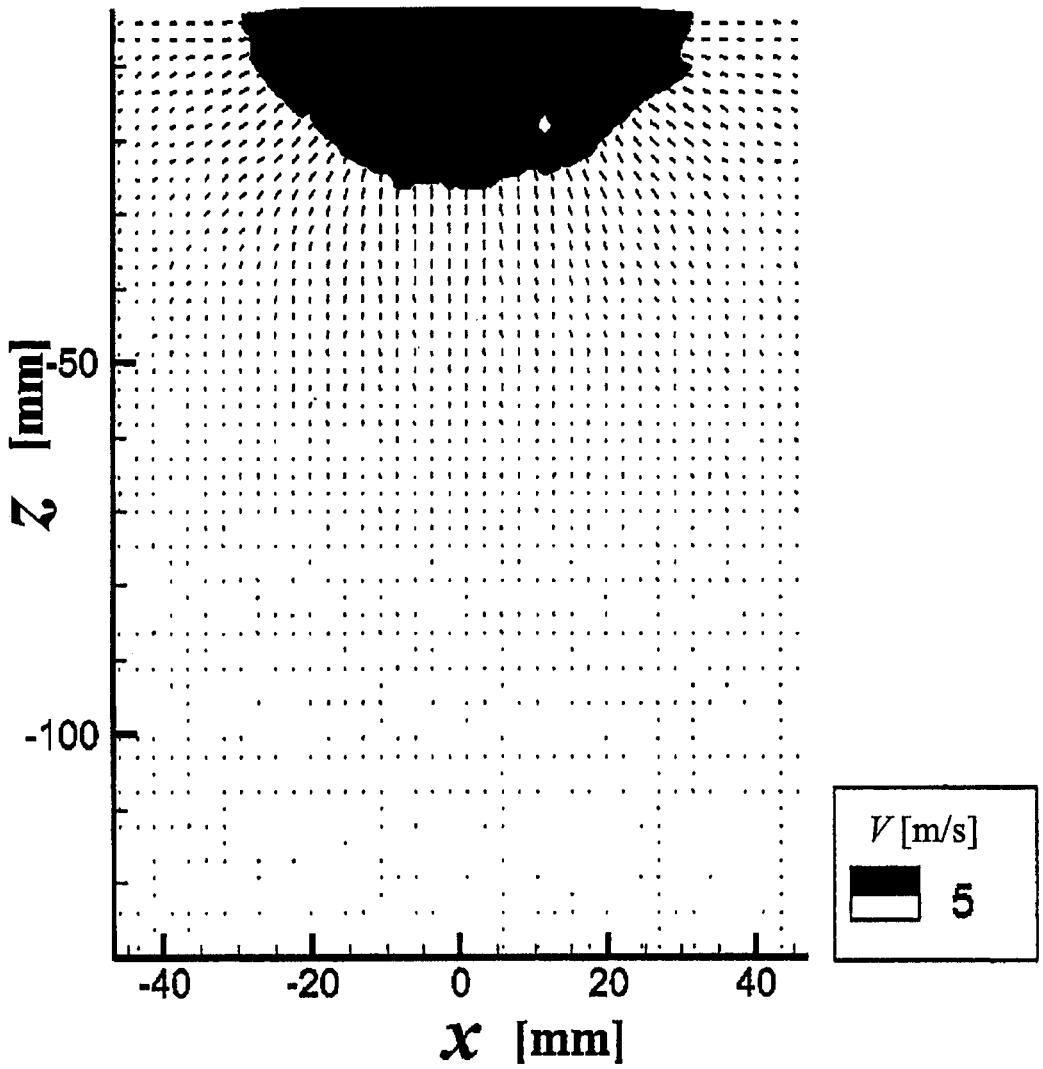
FIG. 8 is a diagram showing a velocity distribution of a potential flow.

FIG. 8 shows the flow velocity distribution of the air in the upward direction when suction is performed in the experimental environment of FIG. 4 in a state without revolution nor rotation. The flow velocity of the solid portion is 5 m/s or more, and the flow velocity of the white portion is less than 5 m/s. This flow velocity distribution is measured by well-known PIV (Particle Image Velocimetry). In the drawing, the vertical axis corresponds to the up-down direction position with the position of the suction port 5 as the zero point, and the horizontal axis corresponds to the horizontal position. In the example of FIG. 8, the upward flow velocity of 5 m/s or more is realized in a semicircular region centered on the revolution center 10 of the suction port 5. In this example, since the velocity field of the potential flow of the air is realized, the velocity of the air is approximately 0 m/s at a position more than 30 mm away from the suction port 5.

Figure 9:
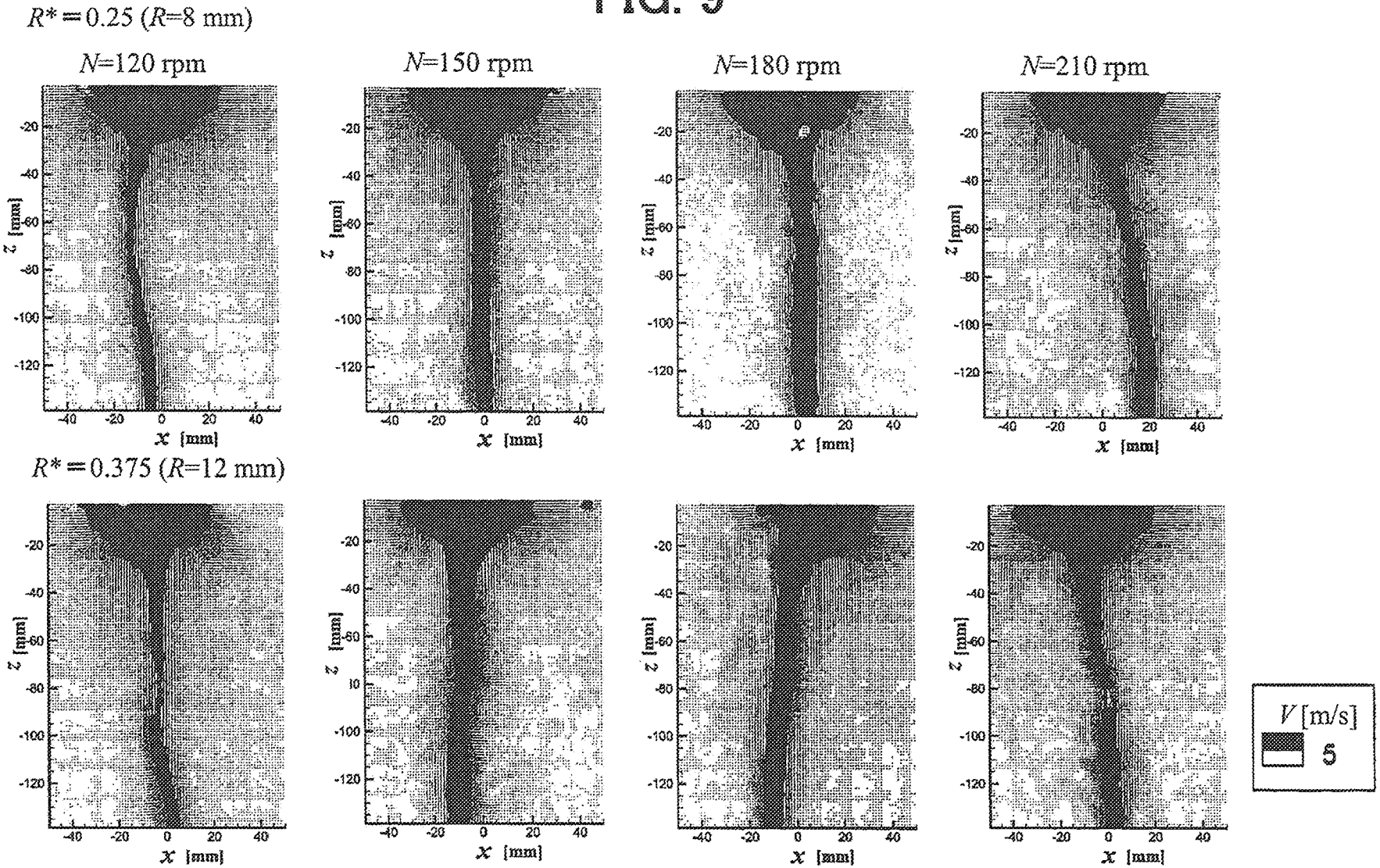
FIG. 9 is a diagram showing a velocity distribution in a case where the suction port is revolved.

FIG. 9 shows the velocity distribution measured by the PIV when the suction port 5 revolves. The flow velocity of the solid portion is 5 m/s or more, and the flow velocity of the white portion is less than 5 m/s. The upper columns in FIG. 9 show the distribution of air flow velocity in the upward direction at various revolution speeds that realized only revolution with the revolution radius R being 8 mm (that is, 0.25 times the inner diameter φ 32 mm of the suction port 5). The lower columns in FIG. 9 show the distribution of air flow velocity in the upward direction as experimental results realized by the revolution only (with the revolution speeds of 120 rpm, 150 rpm, 180 rpm, and 210 rpm from the left side of the column) with the revolution radius R being 12 mm (that is, 0.375 times the inner diameter φ 32 mm of the suction port 5). In either case, a high-speed region is generated in the upper vicinity of the suction port 5 due to the revolution of the suction port 5, and the velocity field (i.e., the artificial tornado 31) of the vortex tube having a high upward flow velocity toward the vertical lower end of the high-speed region is generated from the floor surface 25. Therefore, remote suction of the object placed on the floor surface 25 is possible. Here, the distance between the suction port 5 and the floor surface 25 is 200 mm, but it is 140 mm from the suction port 5 due to measurement limitation of PIV in FIG. 9. That is, the artificial tornado 31 is realized even in a place far from the suction port 5.

Figure 10:
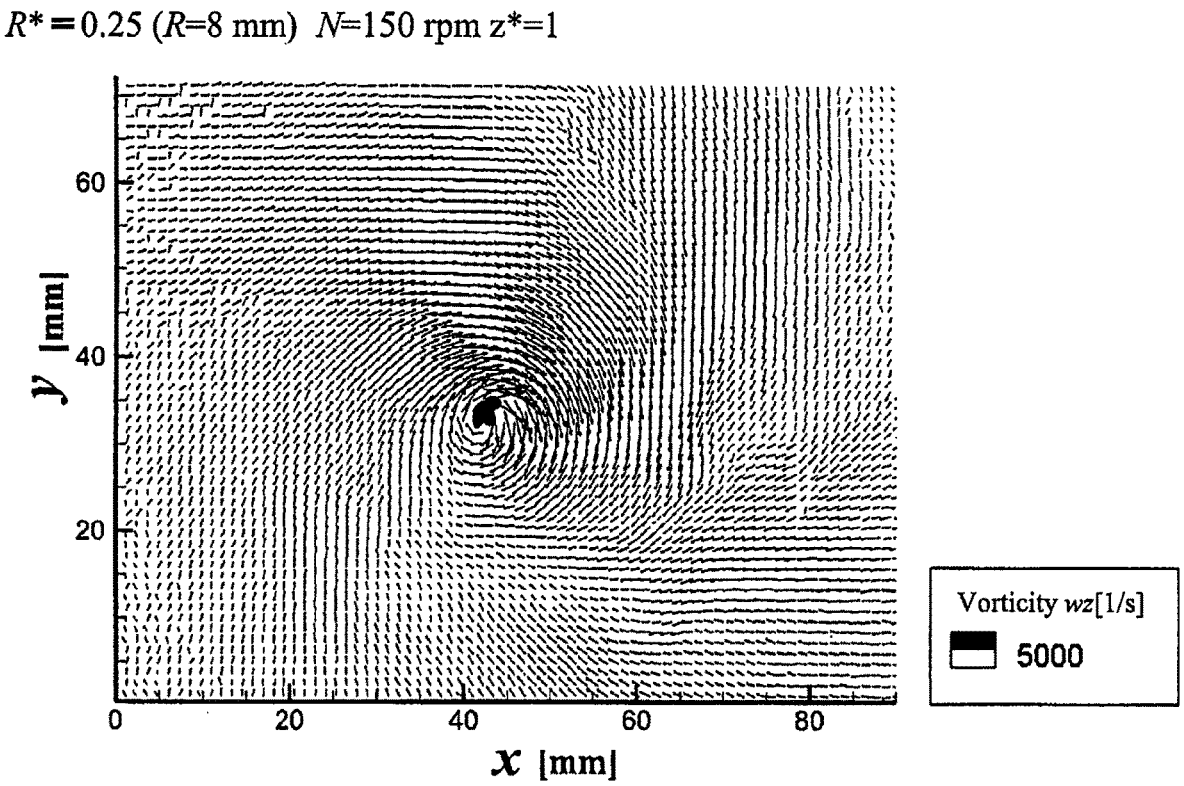
FIG. 10 is a diagram showing a distribution of vorticity on a horizontal plane.

FIG. 10 is a diagram showing the average of the vorticity wz of the air on the horizontal plane for a predetermined time interval under an experiment of only the revolution with the revolution radius R of 8 mm (that is, 0.25 times the inner diameter φ 32 mm of the suction port 5), and the revolution speed of 150 rpm. The distance in the vertical direction from the suction port of the horizontal surface is 32 mm which is the same as the inner diameter of the suction port 5. In addition, the center position of this drawing is adjusted so as to always be located at the center position of the air vortex tube in the above-mentioned predetermined time interval. That is, the center position in the drawing is the origin of the coordinate system moving together with the center position of the air vortex tube. The vorticity wz has a black portion of 5000 (1/s) or more and a white portion less than 5000 (1/s). Therefore, a large vorticity is generated at the center of the vortex tube of air. The arrow marked on the white portion is the circumferential velocity Vθ of the air on the horizontal plane.

Figure 11A:
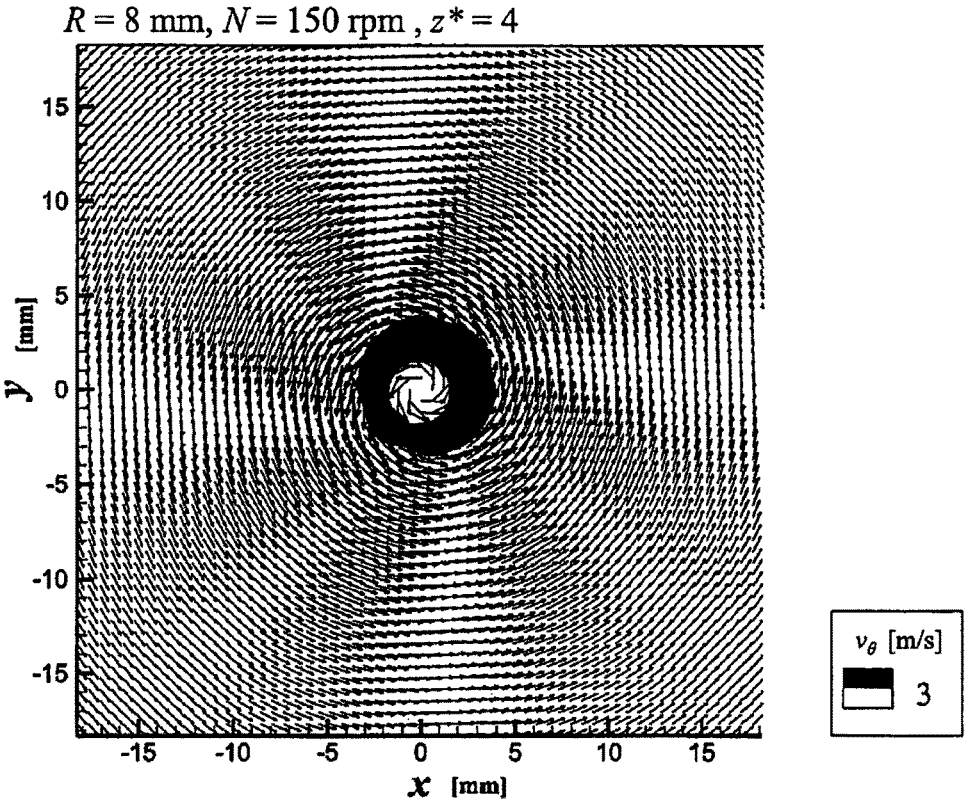
FIG. 11A is a diagram showing a distribution of the circumferential velocity on the horizontal plane.
Figure 11B:
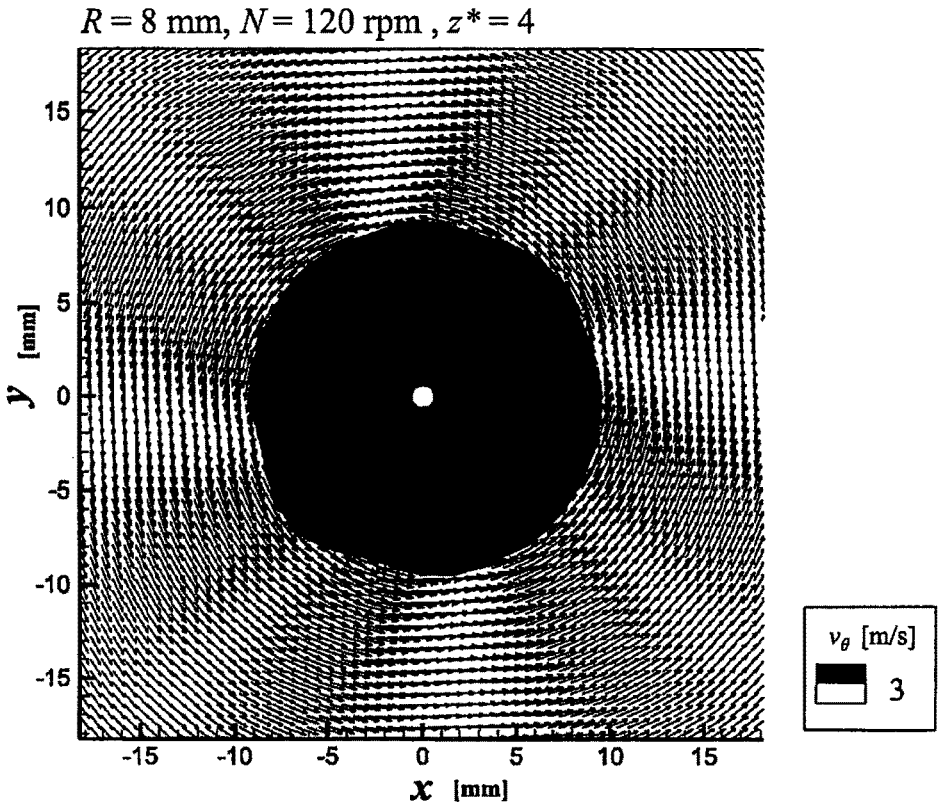
FIG. 11B is a diagram showing the distribution of the circumferential velocity on the horizontal plane.

FIG. 11A shows the average value of the circumferential velocity Vθ of the air on the horizontal plane over the predetermined time interval in an experiment in which the revolution radius R is 8 mm, the revolution speed is 150 rpm, and only the revolution is performed. The distance of the horizontal surface from the suction port is 128 mm which is four times the inner diameter of the suction port 5. In addition, the center position of this drawing is adjusted so as to always be located at the center position of the air vortex tube in the above-mentioned predetermined time interval. The circumferential direction is the circumferential direction centered on the center position of the vortex tube. The circumferential velocity Vθ is 3 m/s or more in the black portion and less than 3 m/s in the white portion. Therefore, the central portion of the air vortex tube has a circumferential velocity Vθ in the range of 3 m/s or more with a donut shape, the circumferential velocity Vθ at the center of the donut is small, and the upward air flow shown in FIG. 9 is large.

FIG. 11A shows the average value of the circumferential velocity Vθ of the air on the horizontal plane over the predetermined time interval in an experiment in which the revolution radius R is 8 mm, the revolution speed is 120 rpm, and only the revolution is performed. The distance of the horizontal surface from the suction port is 128 mm which is four times the inner diameter of the suction port 5. In addition, the center position of this drawing is adjusted so as to always be located at the center position of the air vortex tube in the above-mentioned predetermined time interval. The circumferential velocity Vθ is 3 m/s or more in the black portion and less than 3 m/s in the white portion. Therefore, the central portion of the air vortex tube has a circumferential velocity Vθ in the range of 3 m/s or more with a donut shape, the circumferential velocity Vθ at the center of the donut is small, and the upward air flow shown in FIG. 9 is large.

Figure 12A:
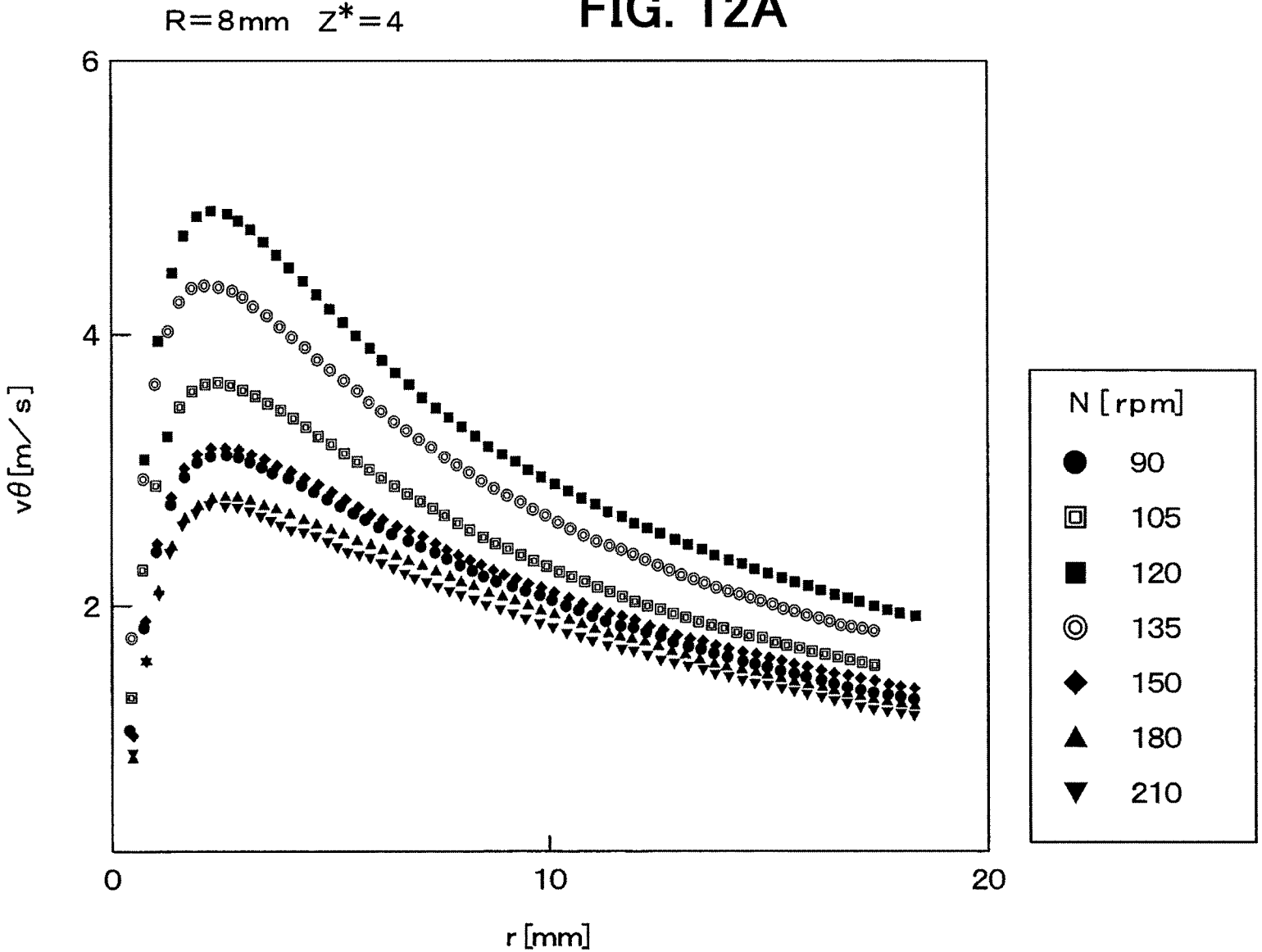
FIG. 12A is a graph showing a radial distribution of the circumferential velocity.

Further, FIG. 12A shows the radial distribution of the average value of the circumferential velocity Vθ of the air over the predetermined time interval. The result shown in FIG. 12A is a result obtained for seven variations of revolution speed N when the revolution radius R is 8 mm. The radial direction referred to here is a radial direction centered on the center of the vortex tube at each time point. The distance of the horizontal surface from the suction port is 128 mm which is four times the inner diameter of the suction port 5. In addition, the center position of this drawing is adjusted so as to always be located at the center position of the air vortex tube in the above-mentioned predetermined time interval.

As shown in FIG. 12A, the circumferential velocity Vθ of the air vortex has a local maximum value. The radially inner side of the local maximum value acts as a rigid vortex where the velocity decreases sharply and becomes nearly 0 m/s at the center. The radially outer side of the local maximum value acts as a free vortex that gradually decreases. That is, this vortex has a circumferential velocity distribution equivalent to that of a general Rankine spiral type tornado.

Here, in the graph of the black circle with the revolution speed N of 150 rpm, the horizontal line is drawn at the circumferential speed Vθ of 3000 mm/s (i.e., 3 m/s) on the vertical axis, the upper portion of the graph is painted black, and the lower portion is painted in white, so that FIG. 11A is prepared.

As shown in FIGS. 9, 11A, 11B and 12A, the artificial tornado 31 has an air flow having a large velocity toward the suction port 5 and a large air flow with a circumferential velocity Vθ having a local maximum value toward a suction port inside the local maximum value.

Figure 12B:
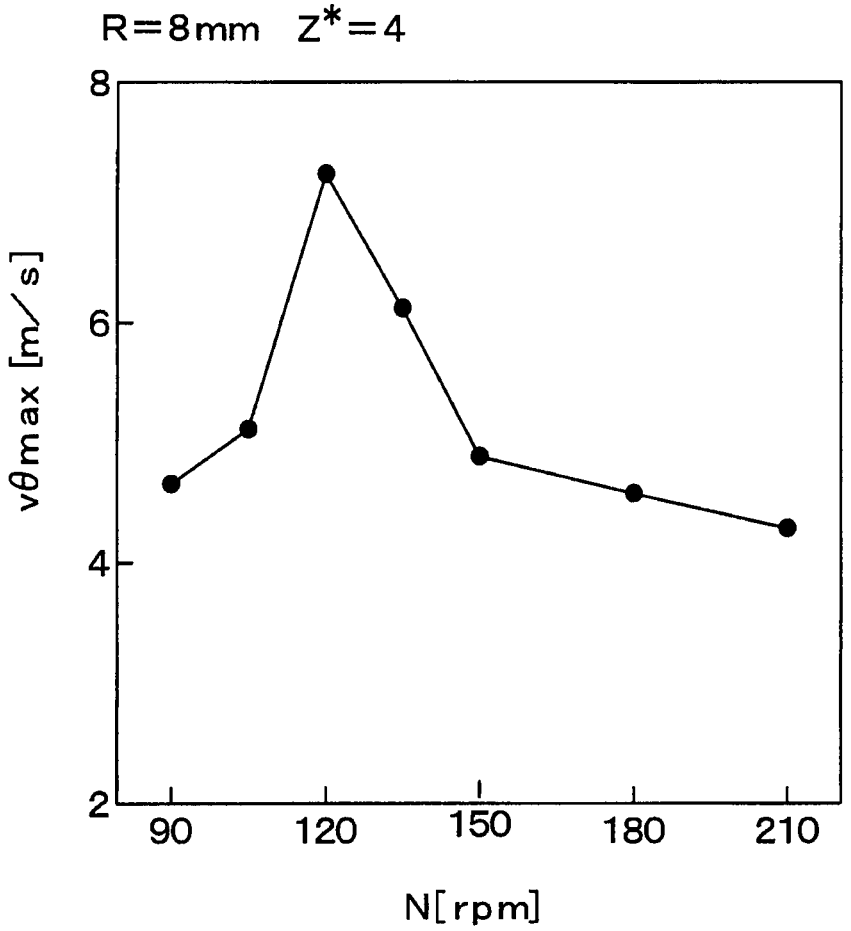
FIG. 12B is a graph showing the relationship between the maximum value of circumferential velocity and the revolution number of revolution.

FIG. 12B is a graph showing the local maximum value in the radial direction distribution of the circumferential velocity Vθ at each revolution speed N in the result shown in FIG. 12A. The horizontal axis corresponds to the revolution speed N, and the vertical axis corresponds to the local maximum value in the radial direction distribution of the circumferential velocity Vθ.

As shown in the drawing, the local maximum value in the radial distribution of the circumferential velocity Vθ increases as N increases in a range of N<120 rpm, reaches the maximum value at N=120 rpm, and decreases as N increases in a range of N>120 rpm.

Figure 13:
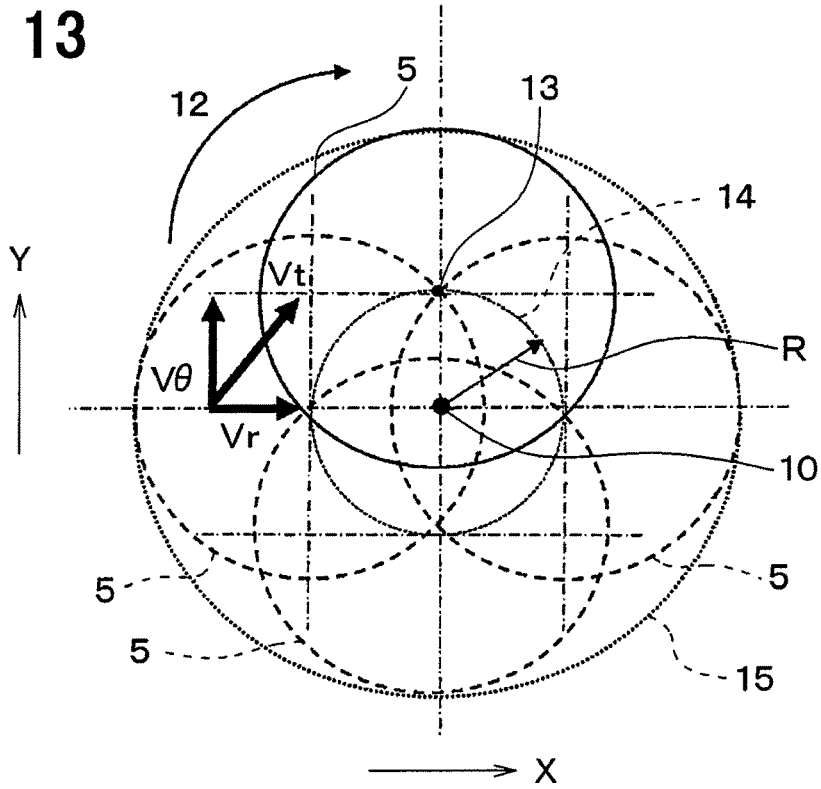
FIG. 13 is a diagram showing the mechanism for generating an artificial tornado (in case of "revolution radius<suction port radius")

FIG. 13 is a conceptual diagram showing the mechanism for generating an artificial tornado in a range of "the revolution radius R<the suction port radius." The suction port 5 revolves around the revolution center 10 in the revolution direction 12. The rotational positions where the suction port 5 is rotated three times by 90° are indicated by three broken lines. The center point of the circular suction port 5 is indicated by the revolution point 13. The trajectory of the revolution point 13 having the revolution radius R is indicated by the revolution locus 14. The suction range covered by the revolution of the suction port 5 is defined as the revolution zone 15.

Since the suction port 5 revolves around 120 rpm while sucking air, two kinds of velocity vectors (i.e., the circumferential velocity vector Vθ and the radial velocity vector Vr) affect on the air on the plane of the revolution zone 15.

Note that the circumferential velocity vector Vθ and the circumferential velocity Vθ are represented by the same notation, but the former is a three-dimensional vector quantity and the latter is a scalar quantity. The magnitude of the circumferential velocity vector Vθ corresponds to the circumferential velocity Vθ.

The circumferential velocity vector Vθ is generated by drawing the air as the continuous fluid in the circumferential direction due to the revolution of the suction port 5 and affects in the circumferential direction of the circle centered on the revolution center 10. The artificial tornado 31 is generated even with only the circumferential velocity vector Vθ.

The radial velocity vector Vr is generated due to the velocity gradient of the suction air volume in the revolution zone 15 caused by the revolution of the suction port 5, and affects in the radial direction of a circle centered on the revolution center 10. The velocity gradient of the suction velocity in the revolution zone 15 increases around the revolution center 10 and decreases as it goes outward. The suction port 5 is constantly sucking around the revolution axis 11, but sucks intermittently by revolution at the outside. Therefore, the radial velocity vector Vr affects in the radial direction of a circle centered on the revolution center 10.

Therefore, the artificial tornado 31 is more strongly and stably generated by the synthetic velocity vector Vt of the circumferential velocity vector Vθ and the radial velocity vector Vr. The synthetic velocity vector Vt directs to the direction of the vortex of the artificial tornado 31.

Figure 14:
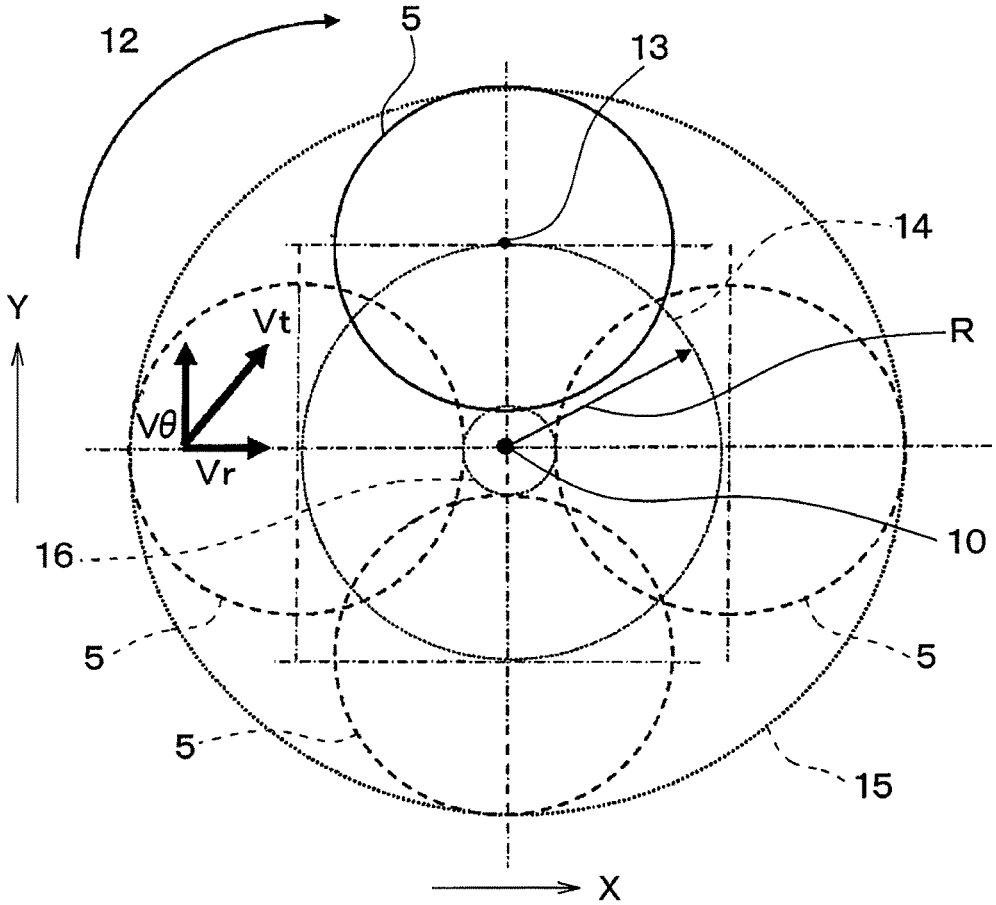
FIG. 14 is a diagram showing the mechanism for generating an artificial tornado (in case of "revolution radius>suction port radius")

FIG. 14 is a conceptual diagram showing the mechanism for generating an artificial tornado in a range of "the revolution radius R>the suction port radius." The suction port 5 revolves around the revolution axis 11 in the revolution direction 12. Three broken lines indicate the positions where the suction port 5 is rotated three times by 90°. The center point of the circular suction port 5 is indicated by the revolution point 13. The trajectory of the revolution point 13 having the revolution radius R is indicated by the revolution locus 14. The suction range covered by the revolution of the suction port 5 is defined as the revolution zone 15. In the vicinity of the revolution center 10, there is a suction port inner trajectory 16 which is the inner trajectory of the suction port 5.

Since the suction port 5 revolves about 120 rpm while sucking air, two types of velocity vectors affect on the air in the revolution zone 15.

The circumferential velocity vector Vθ is generated by drawing the air as the continuous fluid in the circumferential direction due to the revolution of the suction port 5 and affects in the circumferential direction of the circle centered on the revolution center 10. The artificial tornado 31 is generated even with only the circumferential velocity vector Vθ.

The radial velocity vector Vr is generated due to the velocity gradient of the suction air volume in the revolution zone 15 caused by the revolution of the suction port 5, and affects in the radial direction of a circle centered on the revolution center 10. The velocity gradient of the suction velocity in the revolution zone 15 becomes larger near the outside of the suction port inner trajectory 16 and becomes smaller as it goes outward. This is because the suction port 5 intermittently sucks by revolution, the time interval of suction near the outside of the suction port inner trajectory 16 is short, and, on the other hand, the time interval of suction outside the revolution zone 15 becomes longer. Therefore, the radial velocity vector Vr affects in the radial direction of a circle centered on the revolution center 10.

Also, the inside (i.e., the static pressure) of the suction port inner trajectory 16 becomes negative pressure as compared with the atmospheric pressure. That is, the state inside the suction port inner trajectory 16 is equivalent to the suction from the closed space, and the static pressure becomes negative pressure. The reason why the inside of the suction port inner trajectory 16 is in the same state as the closed space is that, since the suction port 5 sucks air at the same time as high-speed rotation of about 120 rpm (i.e., 2 times/second), the sucking of the air on the outside of the revolution zone 15 becomes the suction state from the open space, but the sucking of the air from the inside of the suction port inner trajectory 16 becomes the suction state from the limited space. Therefore, due to this negative pressure, the radial velocity vector Vr affecting in the radial direction of the circle centered on the revolution center 10 is increased.

Hereinafter, the result of subtracting the pressure (i.e., the static pressure) at a certain position from the atmospheric pressure (i.e., the static pressure) is defined as the negative pressure level at the certain position. In the revolution zone 15, the negative pressure level in the radial direction center portion is larger than the negative pressure level in the radial direction outer peripheral portion located radially outside the radial direction center portion around the revolution center 10. More specifically, the negative pressure level in the revolution zone 15 decreases as the distance from the revolution center 10 increases.

Therefore, the powerful artificial tornado 31 is generated by the synthetic velocity vector Vt of the circumferential velocity vector Vθ and the radial velocity vector Vr. The synthetic velocity vector Vt directs to the direction of the vortex of the artificial tornado 31.

Also in case of "revolution radius R<suction port radius" shown in FIG. 13, since a situation for sucking from a range limited to the inside of the revolution zone 15 occurs, a negative pressure is generated. Thus, it is possible to form an artificial tornado 31 which is a directional flow from the suction flow by revolving the suction port 5.

When the artificial tornado 31 occurs in the revolution zone 15 by the above-described mechanism, the artificial tornado 31 develops toward the upstream side of the suction port 5 of the revolution axis 11. Since the air is a continuous fluid, the revolution speed N of the suction port 5 is substantially equal to the revolution number of the vortex of the artificial tornado 31.

At this time, the artificial tornado 31 primarily sucks air from its tip portion and does not suck much from the side thereof. The accompanying flow 33 gently flows toward the outside of the revolution zone 15 of the suction device 1 and is disposed on the side of the artificial tornado 31.

Therefore, the suction device 1 performs the suction with directionality. This directional suction enables remote suction to efficiently suck gas and floating matter disposed in a specific space of the free space in the atmosphere.

The artificial tornado 31 generated in this way includes an upward flow, a circumferential flow, and an inward flow due to a negative pressure. Then, the configuration of the revolution zone 15 induces the circumferential flow and the inward flow in the artificial tornado 31. The upward flow is generated even without the revolution zone 15 (that is, even if the suction port 5 does not revolve).

Further, in the case of "revolution radius R>suction port radius," the static pressure inside the suction port inner trajectory 16 becomes a negative pressure lower than the atmospheric pressure (i.e., the static pressure). As a result, the artificial tornado 31 located outside the suction port inner trajectory 16 is pulled inside the suction port inner trajectory 16. As a result, the artificial tornado 31 is maintained stably for a long period as compared with a related art.

Also in the case of "revolution radius R≤suction port radius," the static pressure in the vicinity of the revolution axis 11 (specifically, inside the revolution locus 14) is a negative pressure that is lower than the atmospheric pressure. As a result, the artificial tornado 31 outside the suction port inner trajectory 16 is pulled to the negative pressure region. As a result, the artificial tornado 31 is maintained stably for a long period as compared with a related art.

Example 2

Figure 15A:
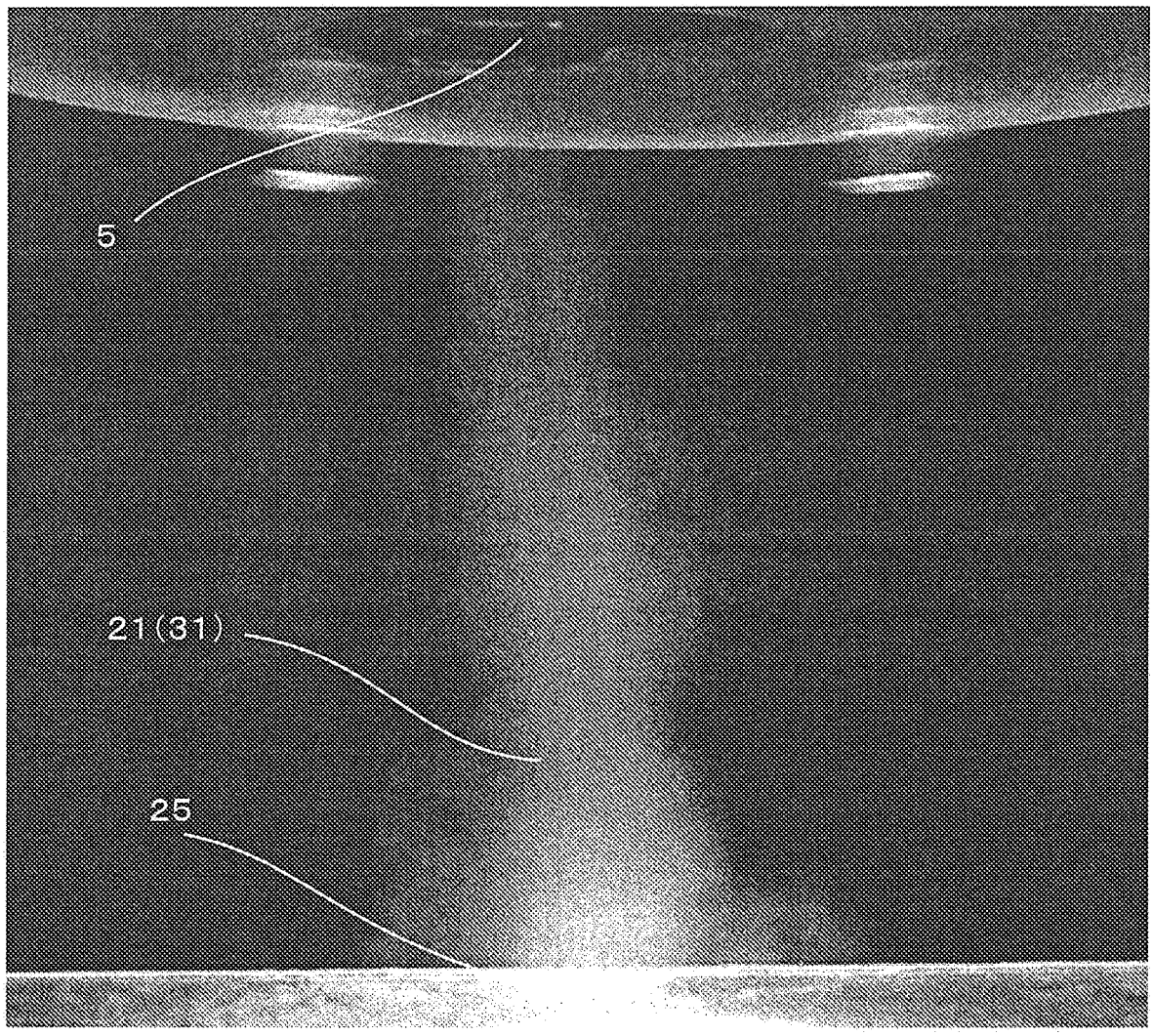
FIG. 15A is a diagram showing the results of Example 2 (i.e., dry ice mist)
Figure 15B:
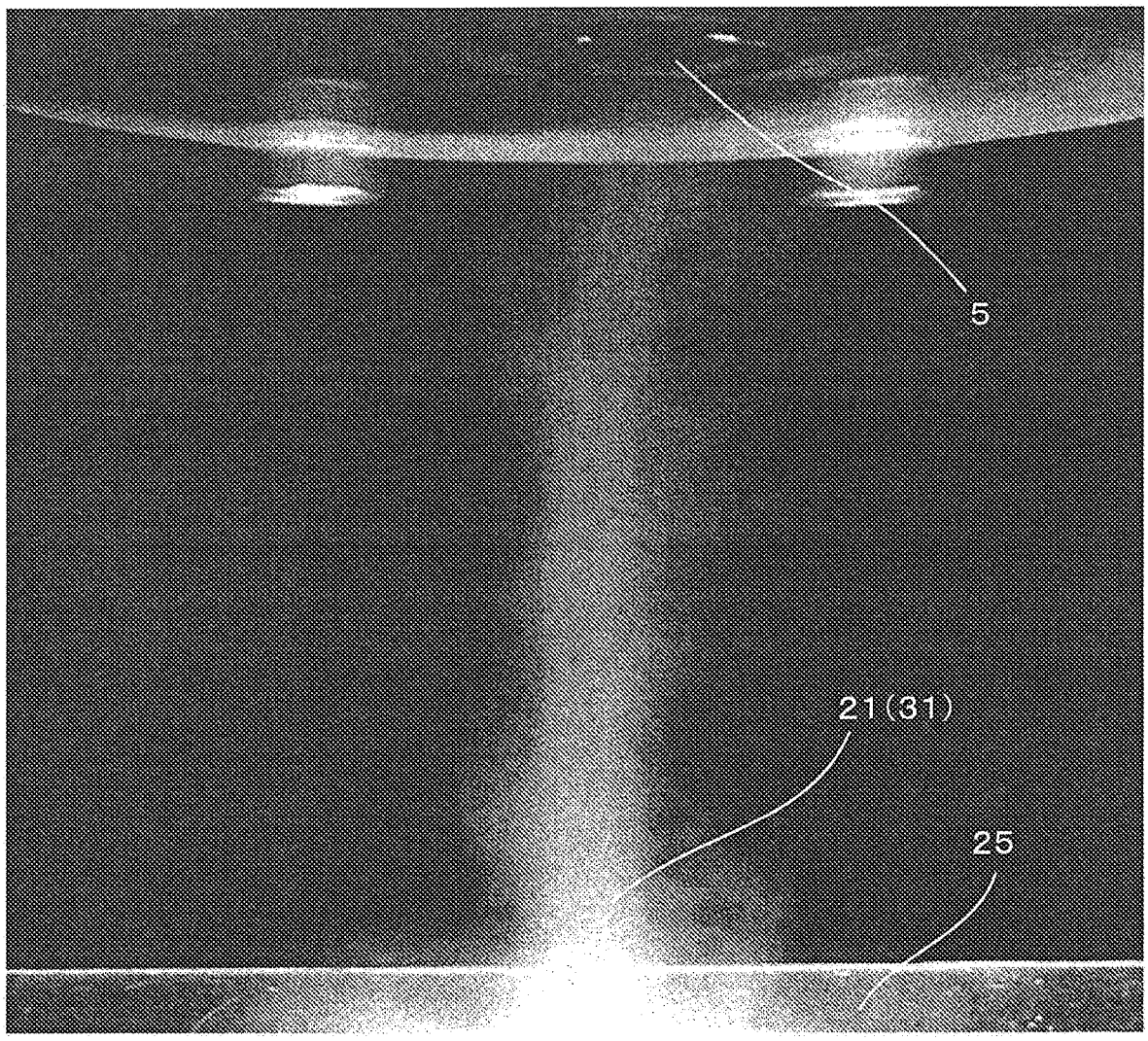
FIG. 15B is a diagram showing the results of Example 2 (i.e., dry ice mist)

In the example 2, the generation situation of the artificial tornado 31 due to the revolution radius R is observed. FIG. 15A and FIG. 15B show the results of Example 2. In this experimental result, dry ice mist is used for visualization of air flow.

FIG. 15A corresponds to Cases 1-10, with the revolution radius R=30 mm, the revolution speed N=120 rpm, the rotation speed n=0 rpm, and the revolution radius R of only revolution=30 mm. FIG. 15B corresponds to Cases 1-5, with the revolution radius R=10 mm, the revolution speed N=120 rpm, the rotation speed n=0 rpm, and the revolution radius R of only revolution=10 mm. The artificial tornado 31 is more stably generated from the low rotation speed (i.e., 120 rpm) with the revolution radius R=30 mm than the revolution radius R=10 mm.

Example 3

In Example 3, the rotation of the suction port 5 is simultaneously applied to the revolution of the suction port 5, and the artificial tornado 31 is observed. The direction of rotation is the same direction as the revolution direction 12. This is for reinforcing the artificial tornado 31 caused by the revolution of the suction port 5 by rotating the suction port duct 6.

FIG. 16 shows experimental conditions of Example 3. In Cases 2-1 to 2-36, the artificial tornado 31 is observed under 36 conditions.

Figure 17A:
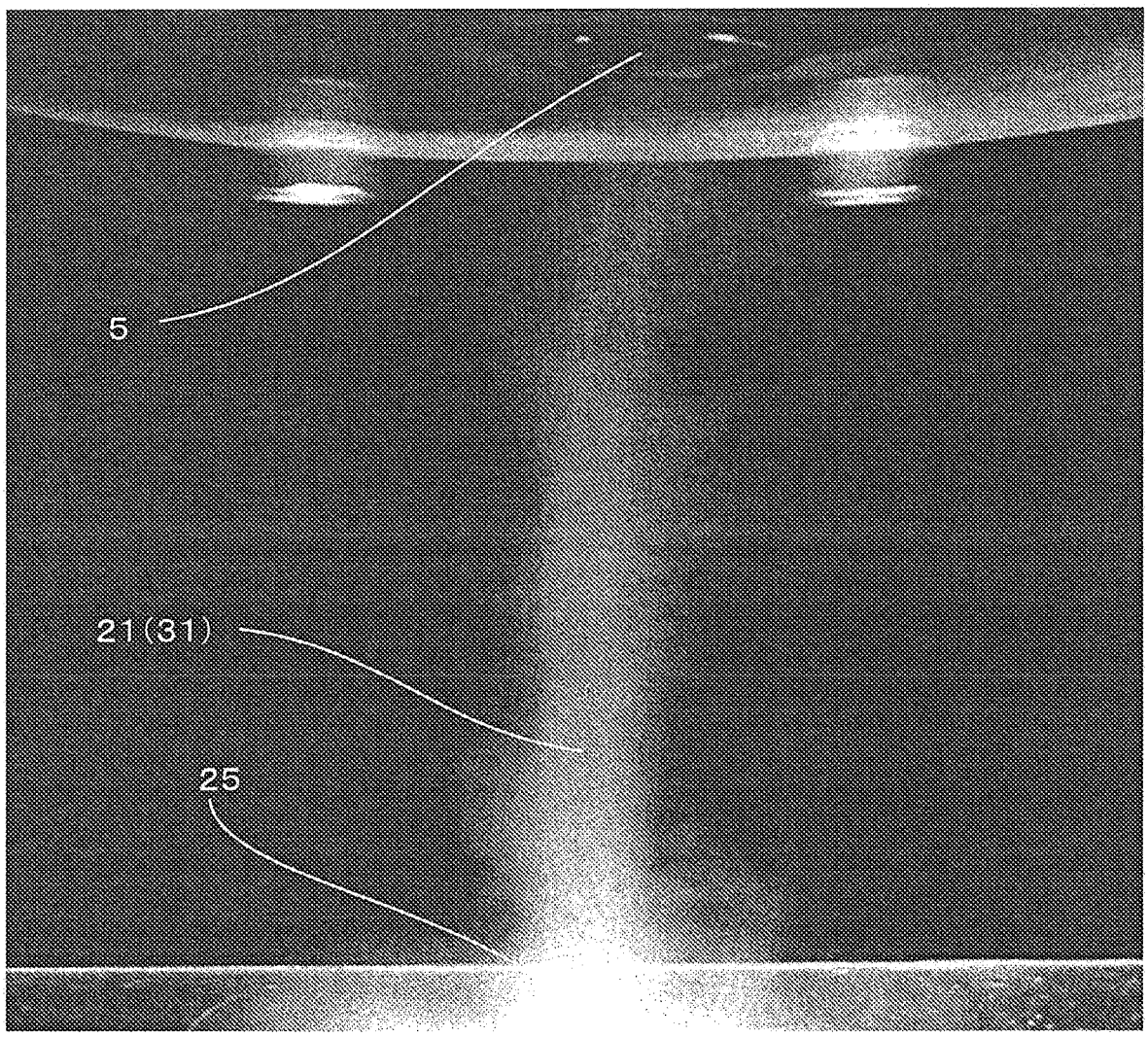
FIG. 17A is a diagram showing the results of Example 3 (i.e., dry ice mist)
Figure 17B:
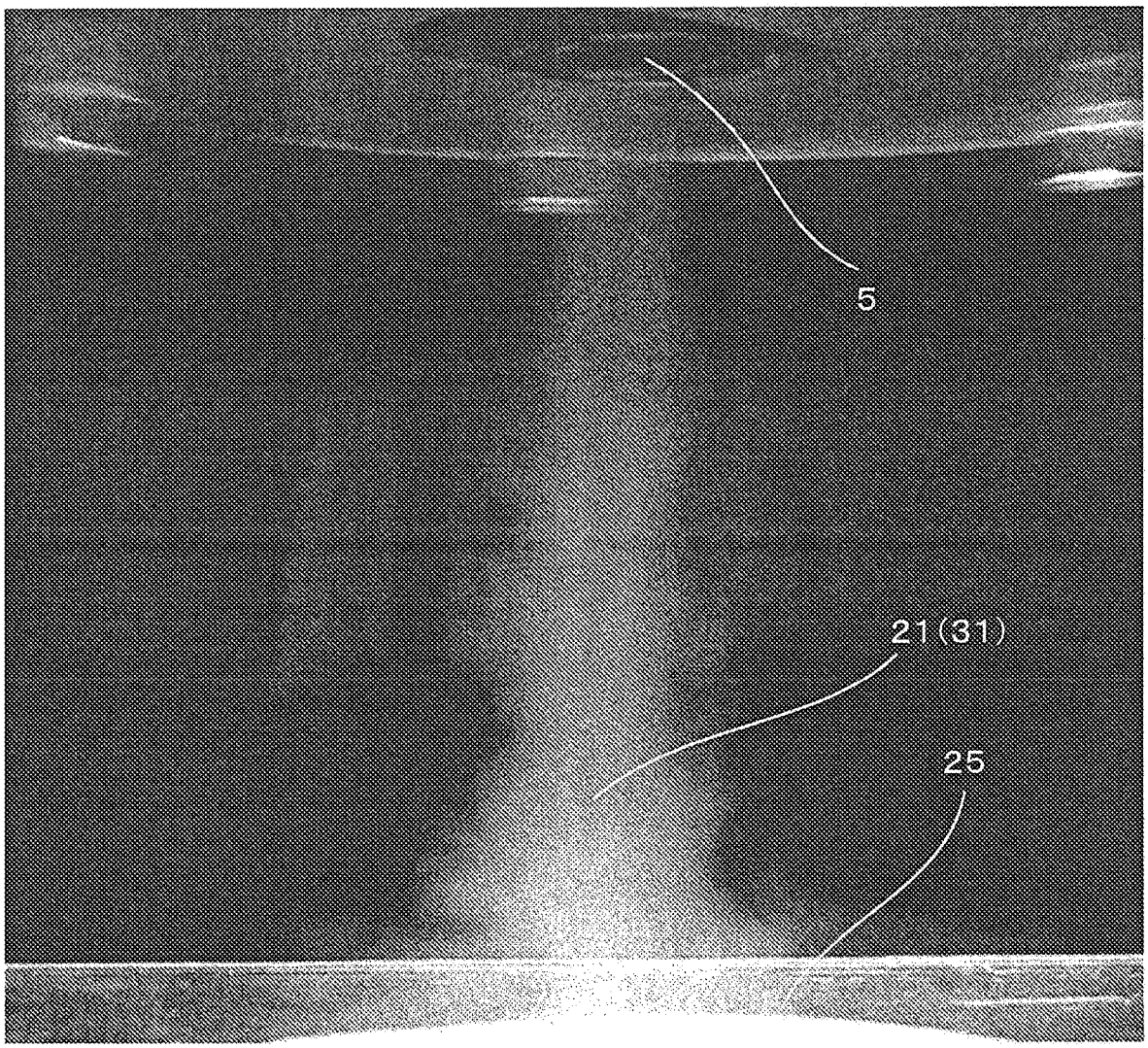
FIG. 17B is a diagram showing the results of Example 3 (i.e., dry ice mist)

FIG. 17A and FIG. 17B show the results of Example 3. In this experimental result, dry ice mist is used for visualization of air flow. FIG. 17A corresponds to Cases 1-5, with revolution radius R=10 mm, revolution speed N=120 rpm, rotation speed n=0 rpm, and revolution only.

FIG. 17B corresponds to Cases 2-11, which is a condition that the revolution and the rotation are simultaneously applied at the revolution radius R=10 mm, the revolution speed N=120 rpm, and the rotation speed n=120 rpm. The artificial tornado 31 is further stabilized when the rotation is applied, as compared with the case of only revolution.

Figure 18A:
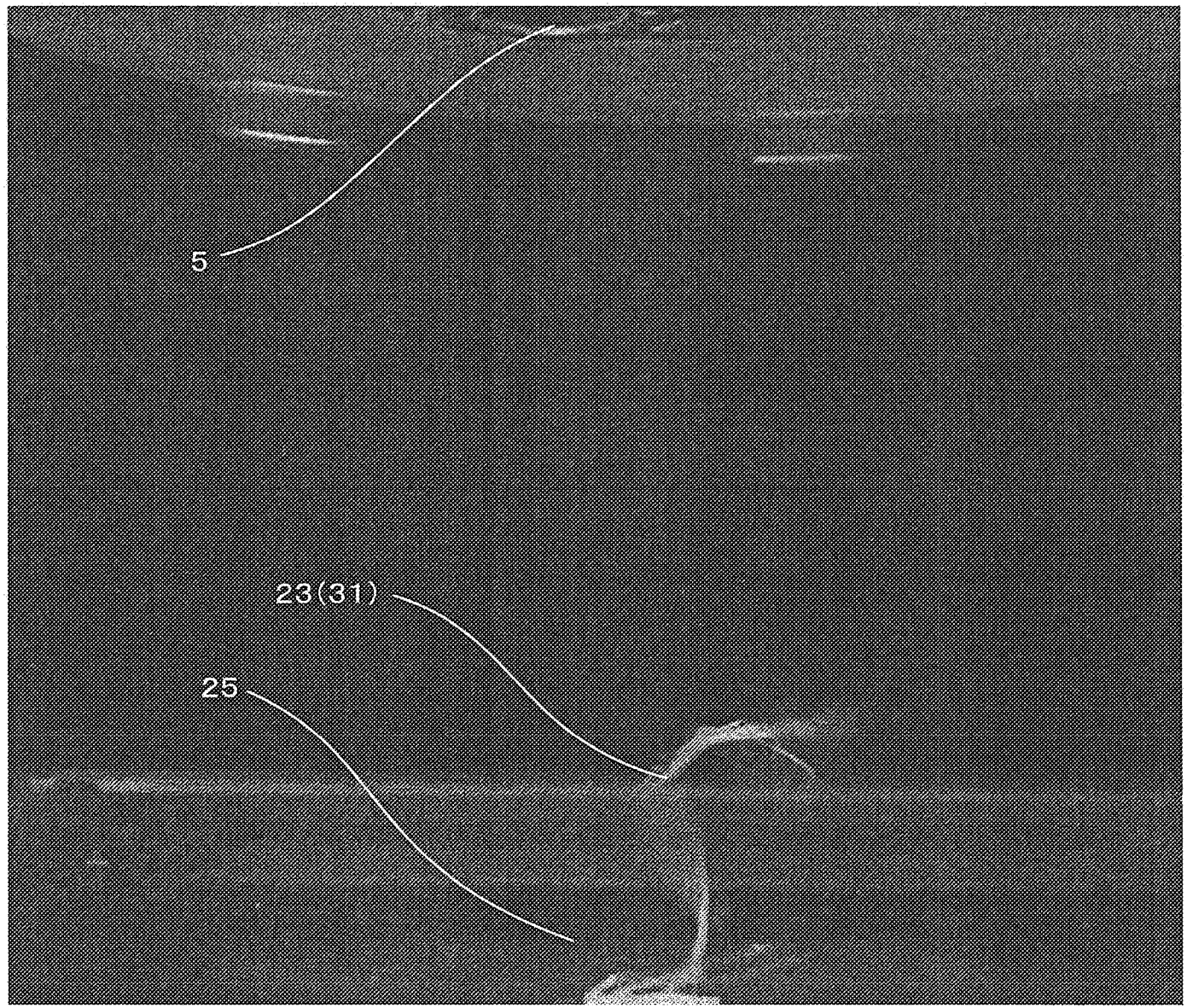
FIG. 18A is a diagram showing the results of Example 3 (i.e., tuft)
Figure 18B:
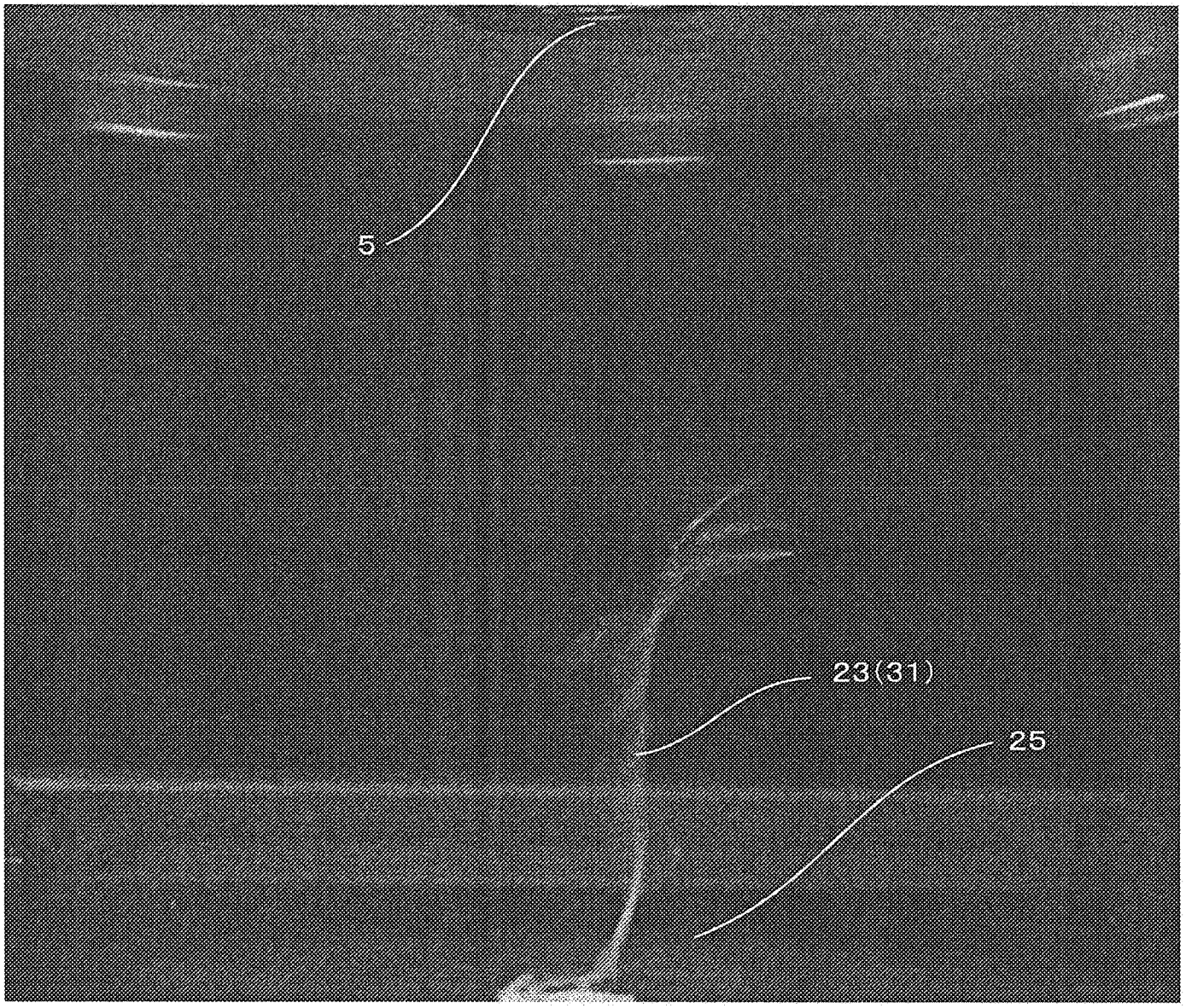
FIG. 18B is a diagram showing the results of Example 3 (i.e., tuft)

FIG. 18A and FIG. 18B show the results of Example 3. In this experimental result, tuft 23 is used for visualization of air flow. The other conditions are the same as those in FIGS. 17A and 17B. Compared to the case of only revolution, it is confirmed such that the taft 23 is lifted much higher and the suction power is increased when the rotation is applied to the revolution.

By rotating the suction port duct 6 in the rotation direction 19, the rotation force in the rotation direction 35 is applied to the artificial tornado 31 as shown in FIG. 3. As a result, the artificial tornado 31 becomes more powerful.

The shape of the revolution trajectory of the revolution trajectory 14 may be not only a circular shape but also an elliptical shape, a rectangular shape, or a hexagonal shape. The shape of the suction port 5 may be not only a circular shape but also an elliptical shape, a square shape, or a hexagonal shape. The strength of the artificial tornado is adjusted by controlling the size (such as a radius) of the suction port 5, the suction flow rate, the revolution radius R, and the revolution speed N. The experimental device of FIG. 4 can rotate the suction port 5, the generation action of the artificial tornado 31 of the suction device 1 of the present invention is caused by the revolution of the suction port 5.

Third Embodiment

Next, a third embodiment will be described with reference to FIG. 19. The air conditioner 60 of the present embodiment is fixed to the ceiling or the side wall of the room. In order to heat the room, the air conditioner 60 heats the air and blows the heated air 61 obliquely downward in the room. In general, during the air heating in the room, the cool air 64 stays below the room and the warm air tends to stay above the room. Such a temperature distribution may lead to deterioration of the heating efficiency since the living space below the room is not warmed up.

Figure 19:
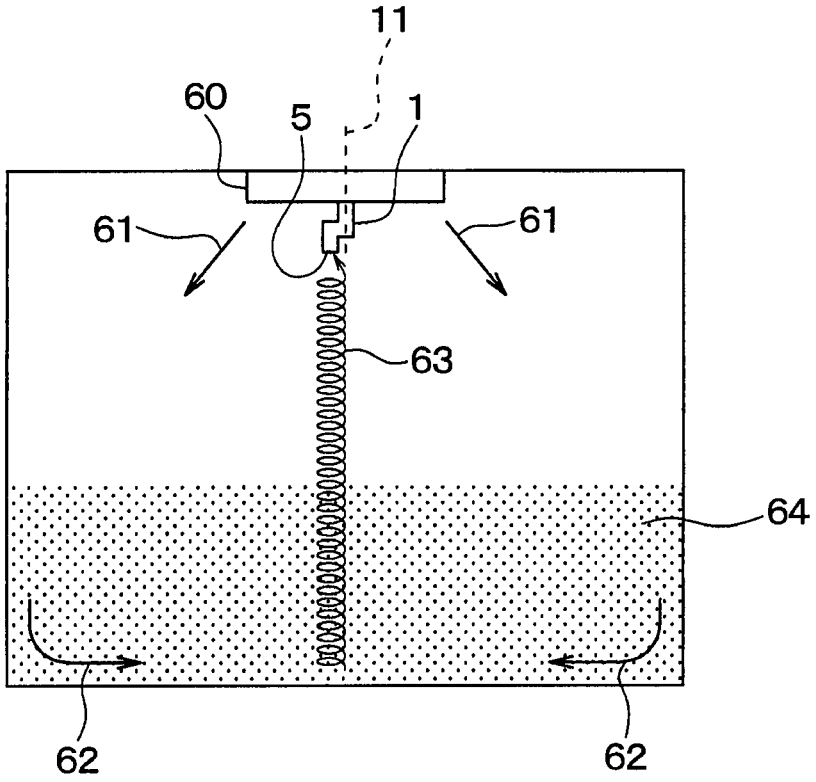
FIG. 19 is a diagram showing an air conditioner according to a third embodiment.

On the other hand, as shown in FIG. 19, the air conditioner 60 of the present embodiment has the suction device 1 according to the first embodiment or the second embodiment. The suction port 5 of the suction device 1 opens vertically downward in the room or obliquely downward in the vertical direction.

The operation mode of the suction device 1 is the same as in the first and second embodiments. When the suction port 5 sucks the air, the suction port 5 revolves around the revolution axis 11, so that an artificial tornado 63 is generated. When the artificial tornado 63 is generated, the cool air below the room is sucked into the suction port 5. As a result, the air (specifically, the warm air) blown out from the air conditioner 60 moves downward in the room as indicated by an arrow 62. As a result, the warm air reaches the lower end of the room as indicated by an arrow 62, the temperature in the lower side of the room rises, and the temperature difference between the upper and lower sides is reduced, so that the heating efficiency is improved.

The cool air sucked by the suction device 1 is heated inside the air conditioner 60, and then blown out again into the room.

According to the first embodiment, the second embodiment, the third embodiment and the examples, the present invention provides the following operations and effects.

First, a suction device 1 having a suction port 5 for sucking a fluid revolves around a revolution axis 11 so that a revolution zone 15 is formed. By revolving the suction port 5 and forming the revolution zone 15, the air is drawn into the suction port 5 in the circumferential direction, and thereby generating the circumferential velocity vector Vθ in the revolution zone 15. The circumferential velocity vector Vθ generates a strong and stable artificial tornado 31.

Since the artificial tornado 31 is generated only by the mechanism for revolving the suction port 5 of the suction device 1, the suction device 1 is made compact. Therefore, it is possible to eliminate a large-sized duct, a hood, and a blower for a jet flow that generates a swirling flow, which are necessary before. However, the suction device 1 of the above-described embodiments may be used in combination with a duct, a hood, and a blower for a jet flow that generates the swirling flow.

The suction speed of the revolution zone 15 has a velocity gradient that decreases from the inside to the outer periphery of the revolution axis. A radial velocity vector Vr affecting in the radial direction of a circle centered on the revolution center 10 is generated by a velocity gradient that decreases from the inside to the outer periphery of the revolution axis.

Also, there is a negative pressure region inside the revolution zone 15. By a negative pressure region inside the revolution zone 15, the radial velocity vector Vr is further strengthened.

Therefore, a powerful and stable artificial tornado can be generated by the synthetic velocity vector Vt between the circumferential velocity vector Vθ and the radial velocity vector Vr.

Further, the suction device 1 has a suction duct which is connected to a suction port duct having a suction port 5 and rotates around the revolution axis. With the suction duct 8 that is connected to the suction port duct 6 having the suction port and rotates around the revolution axis 11, the revolution of the suction port 5 is performed only by the rotation of the suction duct 8. As a result, the mechanism for revolving the suction port 5 is directly connected to the rotation of the motor, so that the mechanism is simplified.

Also, the suction port 5 rotates around the revolution point. By rotating the suction port 5 around the revolution point 13, the artificial tornado is made stronger and more stable. This is because the frictional force generated on the inner wall of the suction port duct 6 is utilized.

INDUSTRIAL APPLICABILITY

The suction device 1 of the present invention may be used for a dust collector, a ventilator, an exhaust device, a low pressure generator, and the like. Specifically, they are a vacuum cleaner, a chip removing device of a machine tool, a dust collector of a blast furnace, a smoke eliminating device, a smoke evacuating device of a grilled meat shop, a liquid level control device, and the like, and the dust collection, ventilation, exhaust, etc. is performed efficiently using the artificial tornado 31. Further, dust and the like scattered in a specific region in the air is collected by focusing on the specific region by the artificial tornado 31. With the artificial tornado 31, catching harmful mosquitoes and the like during flight is also possible. The fluid sucked by the suction device 1 may be not only air, but also other gases such as hydrogen, oxygen, nitrogen and the like. Alternatively, the fluid may be liquid (such as water, alcohol, etc.).

While the present disclosure has been described with reference to embodiments thereof, it is to be understood that the disclosure is not limited to the embodiments and constructions. The present disclosure is intended to cover various modification and equivalent arrangements. In addition, while the various combinations and configurations, other combinations and configurations, including more, less or only a single element, are also within the spirit and scope of the present disclosure.

What is claimed is:

1. A suction device comprising:

a suction port duct having a suction port;

a connection duct connected to the suction port duct; and a suction duct connected to the connection duct, wherein the suction duct extends along and surrounds a revolution axis so that the revolution axis is inside the suction duct and the suction duct is configured to rotate about the revolution axis, and wherein the connection duct extends away from the revolution axis; and wherein the suction port duct is disposed at a position offset from the revolution axis; and wherein in response to the suction duct rotating about the revolution axis, the connection duct, the suction port duct, and the suction port revolve around the revolution axis, and wherein the suction port is configured to suck a fluid from outside the suction device into the suction device.

2. The suction device according to claim 1, further comprising:

a driving device configured to rotate the suction duct about the revolution axis for revolving the suction port around the revolution axis when the suction port sucks the fluid.

3. The suction device according to claim 1, wherein:

the suction port and the suction port duct rotate.

4. The suction device according to claim 1, wherein:

the suction port revolves around the revolution axis to provide a revolution zone in a region inside a trajectory shape drawn by an outermost circumferential portion of the suction port.

5. The suction device according to claim 4, wherein:

when the suction port revolves around the revolution axis, a negative pressure area is generated inside the revolution zone.

6. The suction device according to claim 4, wherein:

a suction speed of the fluid in the revolution zone has a velocity gradient that decreases as the fluid moves away from the revolution axis and toward an outer circumference of the revolution zone.

7. The suction device according to claim 4, wherein the revolution zone has an annular shape.

8. A suction device comprising:

a suction pump having an input, the suction pump configured to create a partial vacuum at the input to suck a fluid from outside the suction device into the input;

a suction duct having one end connected to the input of the suction pump, the suction duct having a longitudinal axis such that the suction duct is disposed coaxially with the longitudinal axis of the suction duct, the suction duct configured to rotate around the longitudinal axis of the suction duct;

a connection duct having one end connected to another end of the suction duct, the connection duct extending away from the longitudinal axis of the suction duct such that a portion of the connection duct is not disposed coaxially with the longitudinal axis of the suction duct; and a suction port duct having one end connected to another end of the connection duct and another end of the suction port duct is open as a suction port, the suction port duct and the suction port being radially offset from the longitudinal axis of the suction duct such that the suction port duct and the suction port are not disposed coaxially with the longitudinal axis of the suction duct, wherein in response to the suction duct rotating around the longitudinal axis of the suction duct, the portion of the connection duct not disposed coaxially with the longitudinal axis of the suction duct, the suction port duct, and the suction port all revolve around the longitudinal axis of the suction duct, and wherein in response to the suction pump creating the partial vacuum at the input, the fluid from outside the suction device is sucked into the suction port, through the suction port duct, the connection duct, and the suction duct, and further into the input of the suction pump, and wherein in response to the fluid from outside the suction device being sucked into the suction port and the suction port revolving around the longitudinal axis of the suction duct, the suction device creates a fluid vortex in the fluid outside the suction device.

9. The suction device of claim 8, wherein the suction port duct has a longitudinal axis, the suction port and the suction port duct being disposed coaxially with the longitudinal axis of the suction port duct, and wherein the suction port duct is configured to rotate around the longitudinal axis of the suction port duct.

10. A suction device comprising:

a suction port duct having a suction port;

a connection duct connected to the suction port duct;

a suction duct connected to the connection duct; and a driving device, wherein the suction duct extends along and surrounds a revolution axis so that the revolution axis is inside the suction duct and the suction duct is configured to rotate about the revolution axis, and wherein the connection duct extends away from the revolution axis; and wherein the suction port duct is disposed at a position offset from the revolution axis; and wherein in response to the suction duct rotating about the revolution axis, the connection duct, the suction port duct, and the suction port revolve around the revolution axis, and wherein the suction port is configured to suck a fluid from outside the suction device into the suction device, and wherein the driving device is configured to revolve the suction port around the revolution axis when the suction port sucks the fluid, and wherein a revolution of the suction port around the revolution axis delineates a revolution zone, the revolution zone being a region inside a trajectory shape of an outermost circumferential portion of the suction port as the suction port revolves around the revolution axis.

11. The suction device according to claim 10, wherein the revolution zone has an annular shape.

* * * * *